US012768092B2

(12) United States Patent
Kim et al.

(10) Patent No.: US 12,768,092 B2
(45) Date of Patent: Oct. 20, 2026

(54) CLOTHES TREATING APPARATUS

(71) Applicant: SAMSUNG ELECTRONICS CO., LTD., Suwon-si (KR)

(72) Inventors: Zoohyeong Kim, Suwon-si (KR); Daegeon Kim, Suwon-si (KR); Jongwon Park, Suwon-si (KR); Jonghun Sung, Suwon-si (KR); Jaewan Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 19 days.

(21) Appl. No.: 18/762,263

(22) Filed: Jul. 2, 2024

(65) Prior Publication Data

US 2025/0075401 A1 Mar. 6, 2025

Related U.S. Application Data

(63) Continuation of application No. PCT/KR2024/006449, filed on May 13, 2024.

(30) Foreign Application Priority Data

Aug. 31, 2023 (KR) ..... 10-2023-0115790
Aug. 31, 2023 (KR) ..... 10-2023-0115791
(Continued)

(51) Int. Cl.
*D06F 39/02* (2006.01)
*D06F 37/04* (2006.01)
(Continued)

(52) U.S. Cl.
CPC ..... *D06F 39/022* (2013.01); *D06F 37/04* (2013.01); *D06F 39/085* (2013.01); *D06F 39/14* (2013.01); *D06F 25/00* (2013.01)

(58) Field of Classification Search
CPC ..... D06F 39/02–028; D06F 39/08–088
See application file for complete search history.

(56) References Cited

U.S. PATENT DOCUMENTS 9,951,461 B2 4/2018 Seo et al.
10,190,251 B2 1/2019 Jo et al.
(Continued)

FOREIGN PATENT DOCUMENTS

CN 114197170 A 3/2022
CN 116411432 A 7/2023
(Continued)

OTHER PUBLICATIONS

International Search Report dated Aug. 23, 2024 for International Application No. PCT/KR2024/006449.
(Continued)

*Primary Examiner* — Omair Chaudhri
(74) *Attorney, Agent, or Firm* — STAAS & HALSEY LLP

(57) ABSTRACT

A clothes treating apparatus includes a housing, a tub inside the housing and having an air inlet to receive air, and an air outlet to discharge air, a drying device to remove moisture from air received through the air outlet, to heat the air, and to supply the heated air to the tub through the air inlet, and a detergent supply module. The detergent supply module includes a base frame, a drain pump having a drain pump outlet, a circulation pump having a circulation pump inlet, a mixing case having a mixing flow path connecting the drain pump outlet and the circulation pump inlet, and a detergent pump on the mixing case and configured to supply a detergent to the mixing flow path. The base frame is detachably mounted to the housing so that the detergent supply module is detachably mounted in the housing below the tub.

18 Claims, 19 Drawing Sheets

(30) Foreign Application Priority Data

Aug. 31, 2023 (KR) ..... 10-2023-0115794
Jan. 3, 2024 (KR) ..... 10-2024-0001049

(51) Int. Cl.
*D06F 39/08* (2006.01)
*D06F 39/14* (2006.01)
*D06F 25/00* (2006.01)

(56) References Cited

U.S. PATENT DOCUMENTS

| | | | | |
|---|---|---|---|---|
| 10,208,423 | B2 | 2/2019 | Jung et al. | |
| 10,815,600 | B2 | 10/2020 | Jung et al. | |
| 11,162,207 | B2 | 11/2021 | Bueno et al. | |
| 2010/0275659 | A1 | 11/2010 | Son et al. | |
| 2017/0191210 | A1* | 7/2017 | Jung | D06F 39/022 |
| 2021/0010185 | A1 | 1/2021 | Bueno et al. | |
| 2021/0310179 | A1 | 10/2021 | Seo et al. | |
| 2022/0120020 | A1 | 4/2022 | Lee et al. | |
| 2023/0212808 | A1 | 7/2023 | Kim | |

FOREIGN PATENT DOCUMENTS

| | | | | | |
|---|---|---|---|---|---|
| EP | 3 192 916 | A1 | | 7/2017 | |
| JP | 2015-62509 | A | | 4/2015 | |
| JP | 2019-107309 | A | | 7/2019 | |
| JP | 2021-181000 | A | | 11/2021 | |
| JP | 7706224 | B2 | * | 7/2025 | D06F 39/088 |
| KR | 10-0878929 | B1 | | 1/2009 | |
| KR | 10-1081241 | B1 | | 11/2011 | |
| KR | 10-1290466 | B1 | | 7/2013 | |
| KR | 10-2013-0106506 | A | | 9/2013 | |
| KR | 10-2014-0045677 | A | | 4/2014 | |
| KR | 20140065859 | A | * | 5/2014 | D06F 39/10 |
| KR | 10-1590012 | | | 2/2016 | |
| KR | 10-2017-0041416 | A | | 4/2017 | |
| KR | 10-2017-0082109 | A | | 7/2017 | |
| KR | 10-1939294 | B1 | | 1/2019 | |
| KR | 10-2020-0021358 | A | | 2/2020 | |
| KR | 10-2124387 | B1 | | 6/2020 | |
| KR | 10-2204006 | | | 1/2021 | |
| KR | 10-2021-0081880 | A | | 7/2021 | |
| KR | 10-2022-0049765 | A | | 4/2022 | |
| KR | 10-2023-0059504 | A | | 5/2023 | |
| KR | 10-2023-0105101 | A | | 7/2023 | |
| WO | WO-2020040453 | A1 | * | 2/2020 | D06F 58/203 |
| WO | WO-2023128153 | A1 | * | 7/2023 | D06F 39/08 |
| WO | WO-2024167230 | A1 | * | 8/2024 | D06F 39/028 |

OTHER PUBLICATIONS

Written Opinion of the International Searching Authority dated Aug. 23, 2024 for International Application No. PCT/KR2024/006449.

European Search Report issued by the European Patent Office (EPO) dated Jun. 4, 2026 for European Application No. 2486048.8.

* cited by examiner

CLOTHES TREATING APPARATUS

CROSS-REFERENCE TO RELATED APPLICATIONS

This is a continuation application, under 35 U.S.C. § 111(a), of International Application PCT/KR2024/006449, filed May 13, 2024, which claims priority under 35 U.S.C. § 119 to Korean Patent Application No. 10-2023-0115790, filed Aug. 31, 2023, Korean Patent Application No. 10-2023-0115791, filed Aug. 31, 2023, Korean Patent Application No. 10-2023-0115794, filed Aug. 31, 2023, and Korean Patent Application No. 10-2024-0001049, filed Jan. 3, 2024 in the Korean Intellectual Property Office, the disclosures of which are incorporated herein in their entireties by reference.

TECHNICAL FIELD

The present disclosure relates to a clothes treating apparatus including a drying device.

BACKGROUND ART

A clothes treating apparatus is an apparatus for treating and/or managing clothes. The clothes treating apparatus may include a drying combined washing machine.

A drying combined washing machine is an apparatus that performs washing through friction between laundry, water, and a detergent put into a tub by stirring the laundry, water, and detergent together using a driving force of a driving motor.

A procedure to be performed by the drying combined washing machine may include a washing process of supplying the detergent and water to the tub accommodating laundry and washing the laundry while rotating a drum, a rinsing process of supplying water to the tub and rotating the drum to rinse the laundry, and a dewatering process of discharging the water from the tub and rotating the drum to remove moisture from the laundry.

The procedure to be performed by the drying combined washing machine may include a drying process of blowing heat generated from a drying device into an accommodating space in which the laundry is accommodated to dry the laundry. The drying combined washing machine may include the drying device to perform the drying process.

DISCLOSURE

Technical Problem

The present disclosure is directed to providing a clothes treating apparatus whose parts may be easily maintained and/or repaired.

Technical tasks to be achieved in this document are not limited to the technical task mentioned above, and other technical tasks not mentioned will be clearly understood by those skilled in the art from the description below.

Technical Solution

In an aspect of the present disclosure, a clothes treating apparatus includes a housing having a laundry inlet, a tub inside the housing and having an air inlet to receive air into the tub, and an air outlet to discharge air from the tub, a drying device above the tub to remove moisture from air received through the air outlet, to heat the air, and to supply the heated air to the tub through the air inlet, and a detergent supply module. The detergent supply module includes a base frame, a drain pump on the base frame and having a drain pump outlet, a circulation pump on the base frame and having a circulation pump inlet, a mixing case on the base frame and having a mixing flow path connecting the drain pump outlet and the circulation pump inlet, and a detergent pump on the mixing case and configured to supply a detergent to the mixing flow path. The base frame is detachably mounted to the housing so that the detergent supply module is detachably mounted in the housing below the tub.

Another aspect of the present disclosure provides a clothes treating apparatus including a housing in which a laundry inlet is formed, a tub provided inside the housing to store washing water, a detergent supply module disposed below the tub to be mounted in the housing, and a detergent box detachably mounted in the housing to be capable of being docked with the detergent supply module. The detergent supply module includes a base frame mounted in the housing, a drain pump and a circulation pump mounted on the base frame, a mixing case mounted on the base frame between the drain pump and the circulation pump to be capable of accommodating at least a portion of the detergent box and form a mixing flow path, and a detergent pump mounted on the mixing case to be capable of being docked with the detergent box and configured to intake a detergent from the detergent box and supply the intaken detergent to the mixing flow path when docked with the detergent box.

MODE OF THE DISCLOSURE

Figure 1:
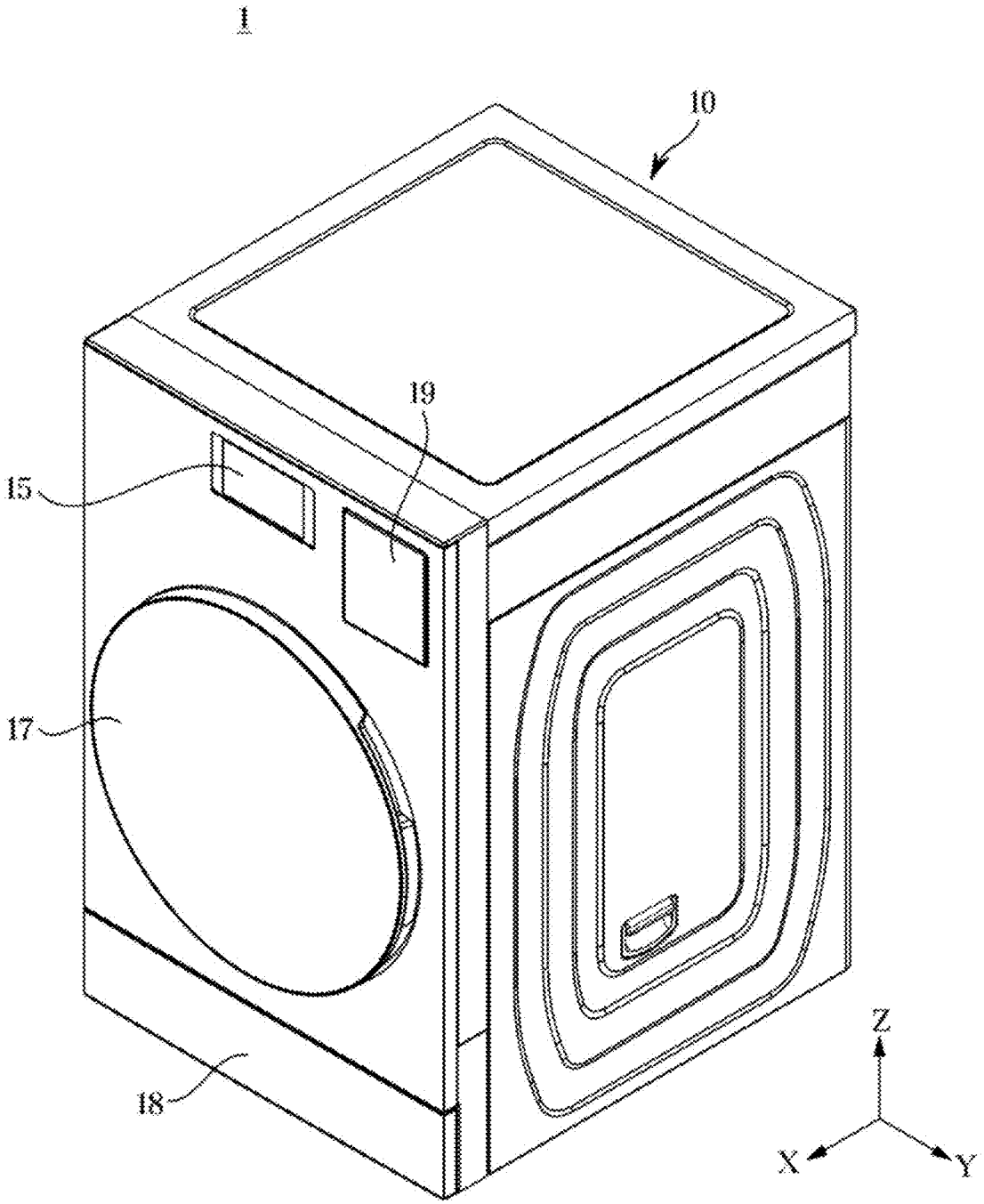
FIG. 1 illustrates a clothes treating apparatus according to an embodiment.

Various embodiments and terms in this document are not intended to limit the technical features described in this document to specific embodiments, and should be understood to include various modifications, equivalents, or substitutes of the embodiments.

In connection with the description of the drawings, like reference numbers may be used for like or related components.

The singular form of a noun corresponding to an item may include one item or a plurality of items, unless the relevant context clearly dictates otherwise.

In this document, each of phrases such as "A or B," "at least one of A and B," "at least one of A or B," "A, B or C," "at least one of A, B and C," and "at least one of A, B, or C" may include any one of the items listed together in the corresponding one of the phrases, or all possible combinations thereof.

The term "and/or" includes any combination of a plurality of related components or any one of a plurality of related components.

Terms such as "first," "second," "primary," and "secondary" may simply be used to distinguish a given component from other corresponding components, and do not limit the corresponding components in any other aspect (e.g., importance or order).

When any (e.g., a first) component is referred to as being "coupled" or "connected" to another (e.g., a second) component with or without the terms "functionally" or "communicatively", this means that the any component may be connected to the other component directly (e.g., by a wire), wirelessly, or through a third component.

The terms "comprises" and "has" are intended to indicate that there are features, numbers, steps, operations, components, parts, or combinations thereof described in this document, and do not exclude the presence or addition of one or more other features, numbers, steps, operations, components, parts, or combinations thereof.

When any component is referred to as being "connected", "coupled", "supported" or "in contact" with another component, this includes a case in which the components are indirectly connected, coupled, supported, or in contact with each other through a third component as well as directly connected, coupled, supported, or in contact with each other.

When any component is referred to as being located "on" or "over" another component, this includes not only a case in which any component is in contact with another component but also a case in which another component is present between the two components.

A washing machine according to various embodiments may perform washing, rinsing, dewatering, and drying processes. The washing machine is an example of a clothes treating apparatus, and the clothes treating apparatus is a concept encompassing an apparatus for washing clothes (objects to be washed, objects to be dried), an apparatus for drying clothes, and an apparatus capable of washing and drying clothes.

A washing machine according to various embodiments may include a top-loading washing machine in which a laundry inlet for putting in or taking out laundry is provided to face the front or a front-loading washing machine in which a laundry inlet is provided to face the front. A washing machine according to various embodiments may include a washing machine of another loading method other than a top-loading washing machine and a front-loading washing machine.

In the case of a top-loading washing machine, laundry may be washed using a water current occurred by a rotating body such as a pulsator. In the case of a front-loading washing machine, laundry may be washed by rotating a drum to repeatedly raise and drop the laundry. A front-loading washing machine may include a drying combined washing machine capable of drying laundry accommodated inside the drum. A drying combined washing machine may include a hot air supply device for supplying high-temperature air into the drum and a condensing device for removing moisture from air discharged from the drum. For example, a drying combined washing machine may include a heat pump device. A washing machine according to various embodiments may include a washing machine using a washing method other than the above-described washing method.

A washing machine according to various embodiments may include a housing accommodating various components therein. The housing may be provided in the form of a box with a laundry inlet formed on one side thereof.

A washing machine may include a door for opening and closing the laundry inlet. The door may be rotatably mounted on the housing by hinges. At least a portion of the door may be transparent or translucent so that the inside of the housing is visible.

A washing machine may include a tub provided inside the housing to store water. The tub may be provided in a substantially cylindrical shape with a tub opening formed on one side thereof, and may be disposed inside the housing so that the tub opening is disposed to correspond to the laundry inlet.

The tub may be connected to the housing by a damper. The damper may absorb vibration that occurs when the drum rotates to attenuate the vibration to be transmitted to the housing.

A washing machine may include a drum provided to accommodate laundry.

The drum may be disposed inside the tub such that a drum opening provided on one side thereof corresponds to the laundry inlet and the tub opening. Laundry may sequentially pass through the laundry inlet, tub opening, and drum opening to be put into the drum or taken out from the drum.

The drum may perform each operation according to a washing, rinsing, and/or dewatering process while rotating inside the tub. A plurality of passing holes is formed on a cylindrical wall of the drum so that water stored in the tub may flow into or out of the drum.

A washing machine may include a driving device configured to rotate the drum. The driving device may include a driving motor and a rotating shaft for transmitting a driving force generated by the driving motor to the drum. The rotating shaft may penetrate the tub to be connected to the drum.

The driving device may rotate the drum forward or backward to perform each operation according to the washing, rinsing, and/or dewatering, or drying process.

A washing machine may include a water supply device configured to supply water to the tub. The water supply device may include a water supply pipe and a water supply valve provided in the water supply pipe. The water supply pipe may be connected to an external water supply source. The water supply pipe may extend from the external water source to a detergent supply device and/or the tub. Water may be supplied to the tub through the detergent supply device. Water may be supplied to the tub without passing through the detergent supply device.

The water supply valve may open or close the water supply pipe in response to an electrical signal from a controller. The water supply valve may allow or block water to be or from being supplied to the tub from the external water source. The water supply valve may include, for example, a solenoid valve that is opened and closed in response to an electrical signal.

A washing machine may include a detergent supply device configured to supply a detergent to the tub. The detergent supply device may include a manual detergent supply device configured such that a user supplies the detergent to be used each time washing, and an automatic detergent supply device configured to store a large amount of detergent and automatically supply a predetermined amount of detergent each time washing. The detergent supply device may include a detergent box for storing the detergent. The detergent supply device may be configured to supply the detergent into the tub in a water supply process. Water supplied through the water supply pipe may be mixed with the detergent by passing through the detergent supply device. The water mixed with the detergent may be supplied into the interior of the tub. The detergent may be used as a term encompassing a detergent for pre-washing, a detergent for main washing, a fabric softener, a bleaching agent, etc. The detergent box may be divided into a detergent storage area for pre-washing, a detergent storage area for main washing, a fabric softener storage area, and a bleaching agent storage area.

A washing machine may include a drainage device configured to discharge water accommodated in the tub to the outside. The drainage device may include a drain pipe extending from a lower end of the tub to the outside of the housing, a drain valve provided on the drain pipe to open and close the drain pipe, and a pump provided on the drain pipe. The pump may pump water in the drain pipe to the outside of the housing.

A washing machine may include a control panel disposed on one surface of the housing. The control panel may provide a user interface for interaction between the user and the washing machine. The user interface may include at least one input interface and at least one output interface.

The at least one input interface may convert sensory information received from the user into an electrical signal.

The at least one input interface may include a power button, an operation button, a course selection dial (or course selection button), and washing/rinsing/dewatering setting buttons. The at least one input interface may include, for example, a tact switch, a push switch, a slide switch, a toggle switch, a micro switch, a touch switch, a touch pad, a touch screen, a jog dial, and/or a microphone, etc.

The at least one output interface may visually or audibly deliver information related to operations of the washing machine to the user.

For example, the at least one output interface may deliver information related to a washing course, operating time of the washing machine, and washing setting/rinsing setting/dewatering setting to the user. The information about the operations of the washing machine may be output on a screen and indicator, as voice, etc. The at least one output interface may include, for example, a liquid crystal display (LCD) panel, a light emitting diode (LED) panel, a speaker, etc.

A washing machine may include a communication module for wired and/or wireless communication with an external device.

The communication module may include at least one of a short-range communication module and a long-distance communication module.

The communication module may transmit data to or receive data from an external device (e.g., server, user device, and/or home appliance). For example, the communication module may establish communication with a server and/or a user device and/or a home appliance, and transmit and receive various data.

To this end, the communication module may support establishment of a direct (e.g., wired) communication channel or wireless communication channel between external devices, and performance of communication through the established communication channel. According to one embodiment, the communication module may include a wireless communication module (e.g., a cellular communication module, a short-range wireless communication module, or a global navigation satellite system (GNSS) communication module), or a wired communication module (e.g., a local area network (LAN) communication module, or a power line communication module). Among these communication modules, the corresponding communication module may communicate with an external device through the first network (e.g., a local area network such as Bluetooth, wireless fidelity (Wi-Fi) direct, or infrared data association (IrDA)) or the second network (e.g., a legacy cellular network, a 5G network, a next-generation communications network, the Internet, or a telecommunications network such as a computer network (e.g., LAN or WAN)). These various types of communication modules may be integrated into one component (e.g., a single chip) or may be implemented as a plurality of separate components (e.g., multiple chips).

The short-range wireless communication module may include, but is not limited thereto, a Bluetooth communication module, a Bluetooth low energy (BLE) communication module, a near field communication module, a WLAN (Wi-Fi) communication module, a ZigBee communication module, an infrared data association (IrDA) communication module, a Wi-Fi direct (WFD) communication module, an ultra-wideband (UWB) communication module, an Ant+ communication module, microwave (U-wave) communication module, and the like.

The long-distance communication module may include a communication module performing various types of long-distance communication and may include a mobile communication device. The mobile communication device transmits and receives wireless signals to and from at least one of a base station, an external terminal, and a server on a mobile communication network.

In one embodiment, the communication module may communicate with external devices such as a server, a user device, and another home appliance through a nearby access point (AP). The access point (AP) may connect the local area network (LAN) to which a washing machine or a user device is connected to a wide area network (WAN) to which a server is connected. The washing machine or the user device may be connected to the server via the wide area network (WAN). The controller may control various components of the washing machine (e.g., driving motor, water supply valve). The controller may control various components of the washing machine to perform at least one process including water supply, washing, rinsing, and/or dewatering according to user input. For example, the controller may control the driving motor to regulate a rotational speed of the drum, or control the water supply valve of the water supply device to supply water to the tub.

The controller may include hardware such as a CPU or memory, and software such as a control program. For example, the controller may include an algorithm for controlling operations of components in a washing machine, at least one memory storing data in the form of a program, and at least one processor performing the operations using data stored in the at least one memory. The memory and processor may each be implemented as a separate chip. The processor may include one or two or more processor chips or one or two or more processing cores. The memory may include one or two or more memory chips or one or two or more memory blocks. The memory and processor may be implemented as a single chip.

Hereinafter, a clothes treating apparatus according to various embodiments will be described in detail with reference to the accompanying drawings. A drying combined washing machine is described below as an example of a clothes treating apparatus, but the present disclosure is not limited to a drying combined washing machine and may be applied to various apparatuses for treating and/or managing clothes.

The terms "front," "rear," "left," and "right" used in the following description are defined based on the drawings, and the shape and location of each component are not limited by these terms.

For example, an X-axis direction may be defined as a front-rear direction, a Y-axis direction may be defined as a left-right direction, and a Z-axis direction may be defined as an up-down direction.

Figure 2:
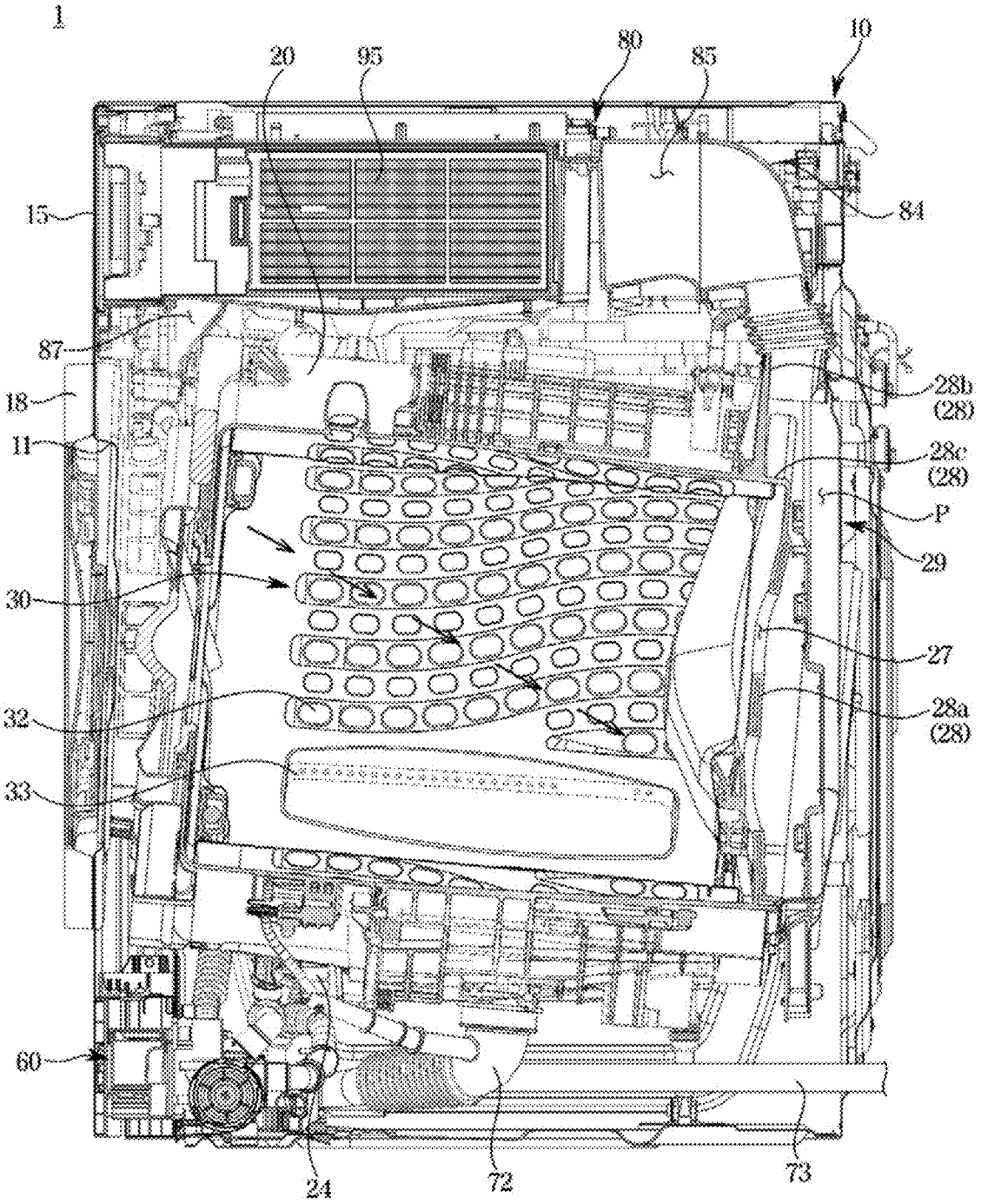
FIG. 2 illustrates a cross-section of the clothes treating apparatus according to an embodiment of the present disclosure.
Figure 3:
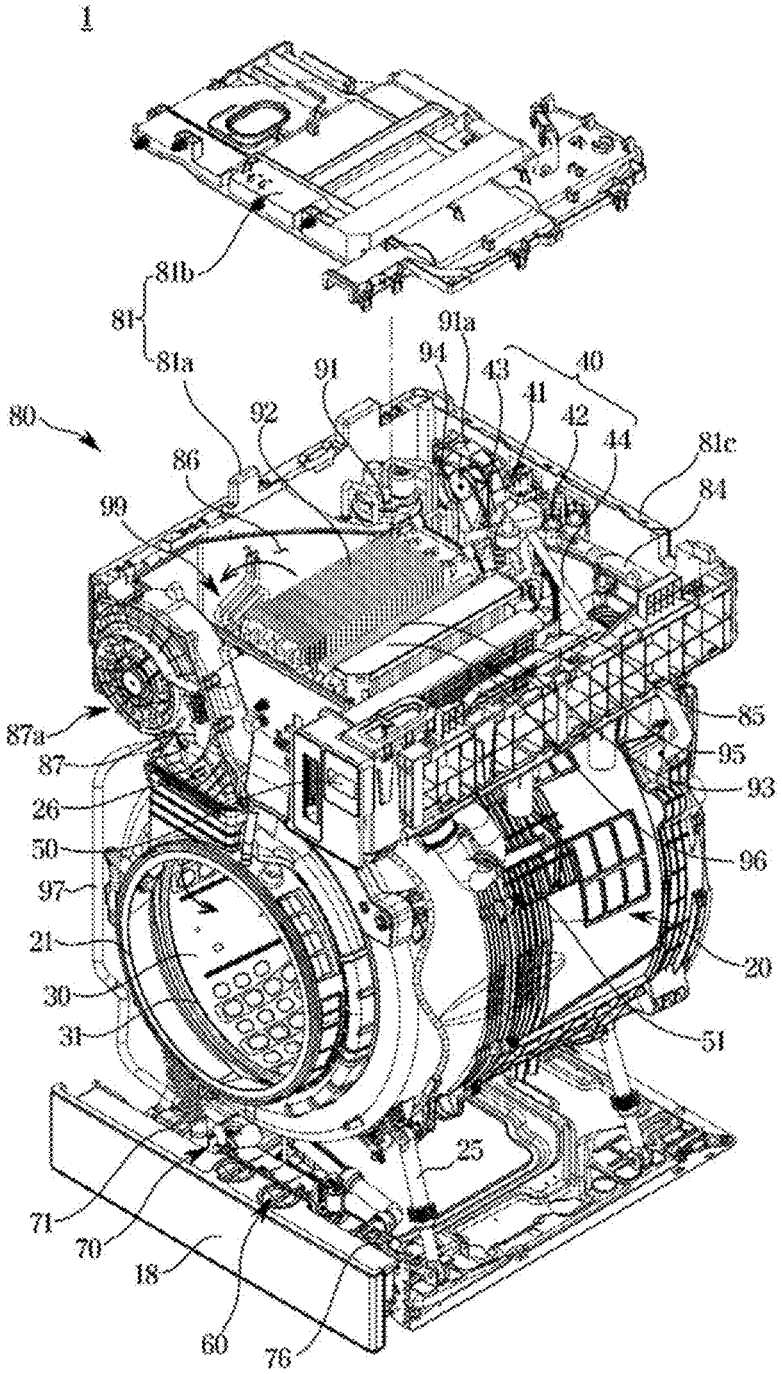
FIG. 3 illustrates some of components disposed inside the clothes treating apparatus according to an embodiment of the present disclosure.
Figure 4:
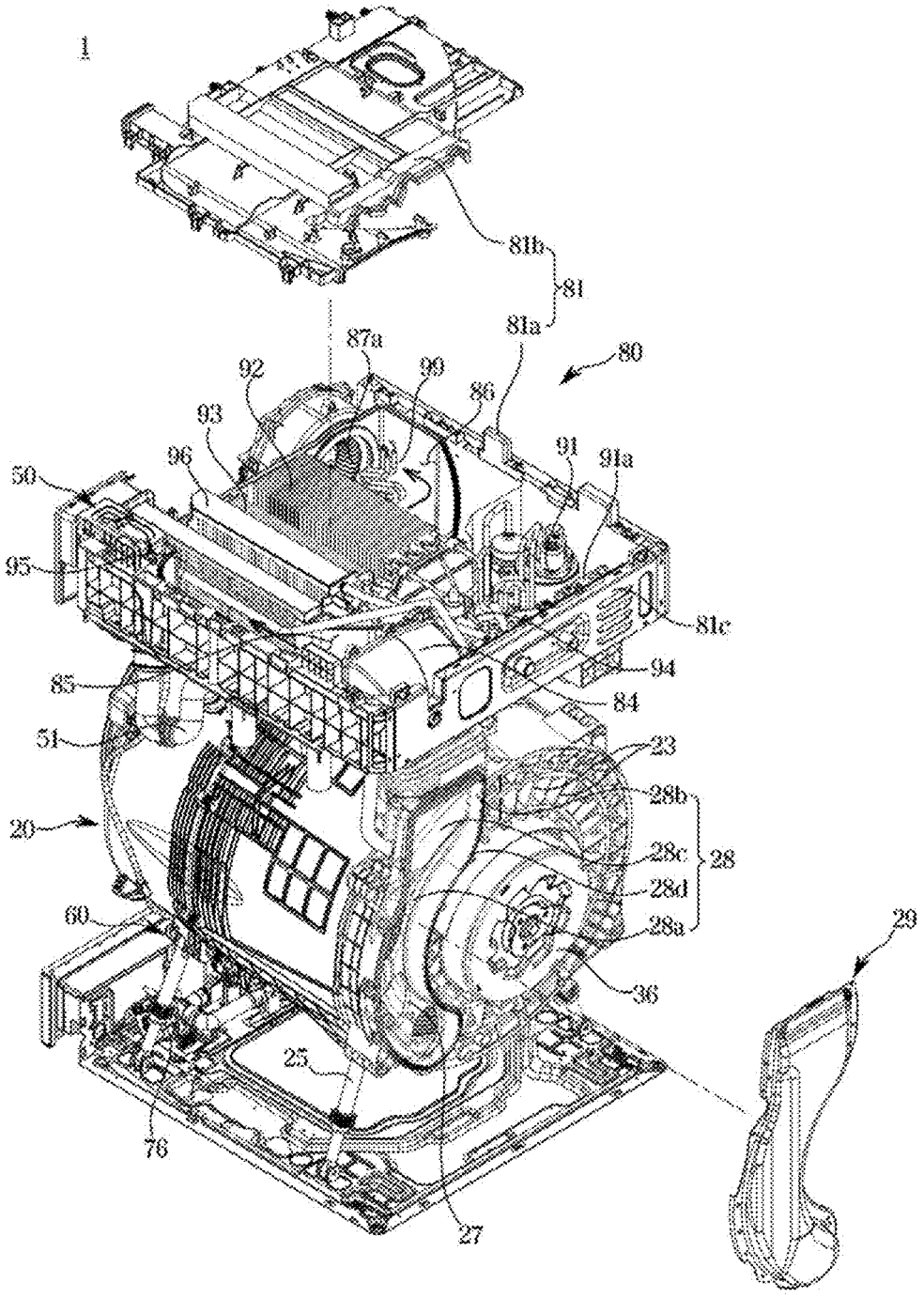
FIG. 4 illustrates components disposed inside the clothes treating apparatus according to an embodiment of the present disclosure in a direction different from that illustrated in FIG. 3.
Figure 5:
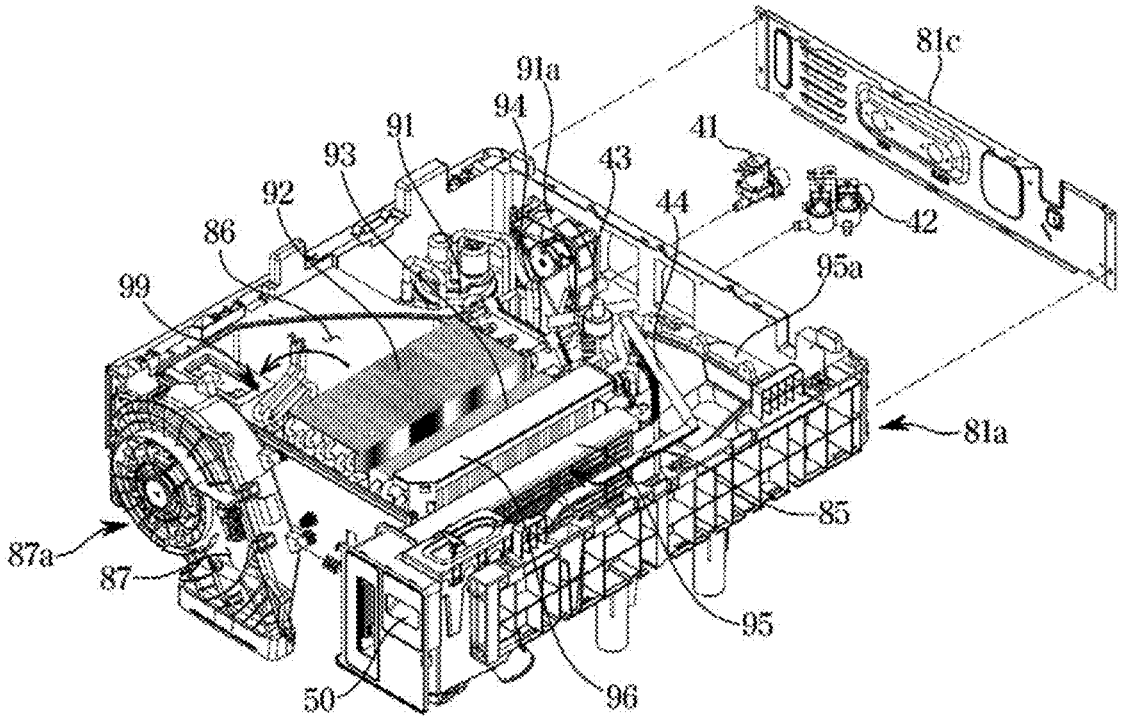
FIG. 5 illustrates some exploded components of a drying device according to an embodiment of the present disclosure.

FIG. 1 illustrates a clothes treating apparatus according to an embodiment. FIG. 2 illustrates a cross-section of the clothes treating apparatus according to an embodiment of the present disclosure. FIG. 3 illustrates some of components disposed inside the clothes treating apparatus according to an embodiment of the present disclosure. FIG. 4 illustrates components disposed inside the clothes treating apparatus according to an embodiment of the present disclosure in a direction different from that illustrated in FIG. 3. FIG. 5 illustrates some exploded components of a drying device according to an embodiment of the present disclosure.

Referring to FIGS. 1 to 5, a clothes treating apparatus 1 according to various embodiments may include a housing 10 accommodating various components therein. The housing 10 may be provided in the form of a box with a laundry inlet 11 formed on one side thereof. The laundry inlet 11 may be provided to face substantially the front.

The clothes treating apparatus 1 may include a laundry door 17 provided to open and close the laundry inlet 11. The laundry door 17 may be rotatably mounted on the housing 10 by hinges. At least a portion of the laundry door 17 may be transparent or translucent so that the inside of the housing 10 is visible. As an example, the laundry door 17 may include tempered glass.

The clothes treating apparatus 1 may include a lower door 18 configured to provide access to a lower detergent supply device 60. The clothes treating apparatus 1 may include an upper door 19 configured to provide access to an upper detergent supply device 50 and a filter 95.

The clothes treating apparatus 1 may include a tub 20 provided inside the housing 10 to store water. The tub 20 may be provided in a substantially cylindrical shape with a tub opening 21 formed on one side thereof, and may be disposed inside the housing 10 so that the tub opening 21 is disposed to correspond to the laundry inlet 11. The tub opening 21 may be provided to face substantially the front.

The tub 20 may be connected to the housing 10 by a damper 25. The damper 25 may absorb vibration occurring when the drum 30 rotates to be attenuate the vibration transmitted to be the housing 10.

The clothes treating apparatus 1 may include a drum 30 provided to accommodate laundry. At least one lifter 33 may be provided inside the drum 30 to perform washing by lifting and dropping laundry.

The drum 30 may be disposed inside the tub 20 such that a drum opening 31 provided on one side thereof corresponds to the laundry inlet 11 and the tub opening 21. Laundry may sequentially pass through the laundry inlet 11, the tub opening 21, and the drum opening 31 to be put into the drum 30 or taken out from the drum 30. The drum opening 31 may be provided to face substantially the front.

The drum 30 may perform each operation according to a washing, rinsing, and/or dewatering process while rotating inside the tub 20. A plurality of passing holes 32 is formed on a cylindrical wall of the drum 30 so that water stored in the tub 20 may flow into or out of the drum 30.

The clothes treating apparatus 1 may include a driving device 36 configured to rotate the drum 30. The driving device 36 may include a driving motor and a rotating shaft for transmitting a driving force generated by the driving motor to the drum 30. The rotating shaft may penetrate the tub 20 to be connected to the drum 30.

The driving device 36 may rotate the drum 30 forward or backward to perform each operation according to the washing, rinsing, and/or dewatering, or drying process.

The clothes treating apparatus 1 may include a water supply device 40 configured to supply water to the tub 20. The water supply device 40 may include water supply valves 41 and 42 connectable to an external water supply source. As an example, the water supply valves 41 and 42 may include the hot water valve 41 for supplying hot water and the cold water valve 42 for supplying cold water.

The water supply device 40 may include water supply pipes 43 and 44. The water supply pipes 43 and 44 may be connected to the water supply valves 41 and 42. As an example, the water supply pipes 43 and 44 may be provided as hoses or pipes made of a flexible material.

As an example, the water supply pipes 43 and 44 may include the hot water pipe 43 connected to the hot water valve 41 and the cold water pipe 44 connected to the cold water valve 42. At least one of the water supply pipes 43 and 44 may guide water from the water supply valves 41 and 42 to the tub 20. At least one of the water supply pipes 43 and 44 may extend from the water supply valve 62 to the tub 20. Water may be supplied to the lower detergent supply device 60 through the tub 20. Water may be supplied to the lower detergent supply device 60 without passing through the tub 20.

The water supply valves 41 and 42 may open or close the water supply pipes 43 and 44 in response to electrical signals from a controller. The water supply valves 41 and 42 may allow or block the supply of water from the external water supply source to the tub 20. The water supply valves 41 and 42 may include, for example, a solenoid valve provided to be opened and closed in response to an electrical signal.

The clothes treating apparatus 1 may include the detergent supply devices 50 and 60 configured to supply a detergent to the tub 20. The detergent supply devices 50 and 60 may include the upper detergent supply device 50 and the lower detergent supply device 60. The detergent may be used as a term encompassing a detergent for pre-washing, a detergent for main washing, a fabric softener, a bleaching agent, etc.

The upper detergent supply device 50 may be located above the tub 20. The upper detergent supply device 50 may be located above the tub 20 in an up-down direction. The upper detergent supply device 50 may include a manual detergent supply device configured such that a user supplies the detergent to be used each time washing, or an automatic detergent supply device configured to store a large amount of detergent and automatically supply a predetermined amount of detergent each time washing. The upper detergent supply device 50 may be connected to the tub 20 through a detergent connection pipe 51. As an example, the upper detergent supply device 50 may be provided to supply a solid washing detergent and/or softener to the tub 20. However, the type of detergent is not limited to the above example.

The lower detergent supply device 60 may be located below the tub 20. The lower detergent supply device 60 may be located below the tub 20 in the up-down direction. The lower detergent supply device 60 may include a manual detergent supply device configured such that the user supplies the detergent to be used each time washing, or an automatic detergent supply device configured to store a large amount of detergent and automatically supply a predetermined amount of detergent each time washing. As an example, the lower detergent supply device 60 may be provided to supply a liquid washing detergent and/or softener to the tub 20. However, the type of detergent is not limited to the above example.

The clothes treating apparatus 1 may include a drainage device 70 configured to discharge water accommodated in the tub 20 to the outside. The drainage device 70 may include a drain pump 71 provided to discharge water in the tub 20 to the outside of the housing 10.

The clothes treating apparatus 1 may include a circulation pump 76 provided to circulate water in the tub 20 back to the tub 20 through the lower detergent supply device 60.

The drainage device 70 may be connected to the tub 20 through a tub connection pipe 72. The drain device 70 may discharge water in the tub 20 to the outside of the housing 10 through a drain pipe 73.

The clothes treating apparatus 1 may include a control panel 15 disposed on one surface of the housing 10. The control panel 15 may provide a user interface for interaction between the user and the clothes treating apparatus 1. The user interface may include at least one input interface and at least one output interface.

The at least one input interface may convert sensory information received from the user into an electrical signal.

The at least one input interface may include a power button, an operation button, a course selection dial (or course selection button), and washing/rinsing/dewatering setting buttons. The at least one input interface may include, for example, a tact switch, a push switch, a slide switch, a toggle switch, a micro switch, a touch switch, a touch pad, a touch screen, a jog dial, and/or a microphone, etc.

The at least one output interface may visually or audibly deliver information related to operations of the clothes treating apparatus 1 to the user.

For example, the at least one output interface may deliver information related to a washing course, operating time of the clothes treating apparatus 1, and washing setting/rinsing setting/dewatering setting to the user. The information about the operations of the clothes treating apparatus 1 may be output on a screen and indicator, as voice, etc. The at least one output interface may include, for example, a liquid crystal display (LCD) panel, a light emitting diode (LED) panel, a speaker, etc.

The clothes treating apparatus 1 may include a drying device 80 configured to dry laundry accommodated inside the drum 30. The drying device 80 may be configured to heat air and supply the heated air to the inside of the tub 20. The drying device 80 may be configured to dry and heat air discharged from the tub 20 and circulate the dried and heated air inside the tub 20 to dry clothes inside the drum 30. The drying device 80 according to various embodiments may be disposed above the tub 20.

The drying device 80 may include a drying case 81 in which a heat pump for drying air may be installed. The drying case 81 may include a drying base 81*a* and a drying cover 81*b* coupled to the drying base 81*a* to form a flow path allowing air to move. The drying cover 81*b* may cover an open upper side of the drying base 81*a*.

Referring to FIG. 5, as an example, the drying device 80 may include a rear cover 81*c* capable of being coupled to a rear side of the drying base 81*a*. The rear cover 81*c* may form at least a portion of a rear surface of the drying device 80. The water supply valves 41 and 42 may be mounted on the rear cover 81*c*.

The drying device 80 according to various embodiments may be configured as a heat pump type. The drying device 80 may include a compressor 91, a condenser 92, an evaporator 93, an expansion valve, and a refrigerant pipe 94 through which a refrigerant circulates. The compressor 91, condenser 92, evaporator 93, and the like constituting the heat pump may be disposed in the drying case 81. For example, the drying device 80 may include a cooling fan 91*a* for cooling the compressor 91. As an example, the drying device 80 may be mounted as a single module.

The compressor 91 may compress the refrigerant, and the compressed high-temperature and pressure refrigerant may move to the condenser 92. The condenser 92 may cool the refrigerant to heat the surrounding air. The heated air may be introduced into the drum 30 to dry clothes.

The refrigerant expanded through the expansion valve may absorb heat from the evaporator 93 to cool the surrounding air. That is, the evaporator 93 can remove moisture by cooling high-temperature and humid air passed through the inside of the drum 30. The air from which moisture has been removed passes through the condenser 92 and exchanges heat with the refrigerant passing through the condenser 92, thereby being heated again. That is, the condenser 92 may heat the air passed through the evaporator 93. The condenser 92 and evaporator 93 may be referred to as heat exchangers.

As an example, the drying device 80 may further include a drying heater 99. The drying heater 99 may increase a drying efficiency of the drying device 80. As an example, the drying device 80 may replace the components of the heat pump with the drying heater 99.

The drying heater 99 may heat the air introduced into the drying device 80. The drying heater 99 may be disposed on a heating flow path 86. The drying heater 99 may be disposed downstream of the condenser 92 along the flow of air passing through the drying device 80. The drying heater 99 may be provided in a relatively small size to minimize a flow path resistance. For example, the drying heater 99 may be a sheath heater.

The drying device 80 according to various embodiments may be disposed above the tub 20. An inlet flow path 85 into which air discharged from the tub 20 is introduced may be formed in the drying device 80. The heating flow path 86 may be formed in the drying device 80 to allow heat exchange of air introduced into the drying device 80 through the inlet flow path 85. A supply flow path 87 may be formed in the drying device 80 through which the air heat-exchanged while passing through the heating flow path 86 is supplied to the tub 20.

The inlet flow path 85 may be provided to allow air passed through the inside of the tub 20 to be introduced into the drying device 80. The inlet flow path 85 may be located above the tub 20. The inlet flow path 85 may communicate with an exhaust flow path P formed at the rear of the tub 20.

The drying device 80 may include an inlet guide 84 connected to the tub 20. The inlet guide 84 may guide the air discharged from the tub 20 to the inlet flow path 85. The inlet flow path 85 may communicate with the exhaust flow path P formed in the tub 20 through the inlet guide 84. The air passed through the exhaust flow path P may be introduced into the inlet flow path 85 of the drying device 80 through the inlet guide 84.

The filter 95 may be provided in the inlet flow path 85 to filter out foreign substances such as lint contained in the air introduced from the tub 20 through the exhaust flow path P. The air introduced into the inlet flow path 85 may pass through the filter 95 and then move to the heating flow path 86. The filter 95 may be located on a flow path through which air introduced into the drying device 80 moves to the evaporator 93 and the condenser 92.

The condenser 92 and the evaporator 93 may be disposed in the heating flow path 86. Because the air introduced into the heating flow path 86 has passed through the inside of the tub 20, the air may be humid. The humid air may be cooled in the evaporator 93 disposed in the heating flow path 86 to remove moisture. The air from which moisture has been removed in the evaporator 93 may be heated again while passing through the condenser 92.

The drying device 80 may include a nozzle device 96 to clean the condenser 92 and/or the evaporator 93. The nozzle device 96 may be provided in the heating flow path 86. The nozzle device 96 may receive water from the water supply device 40 and inject cleaning water toward the condenser 92 and/or the evaporator 93.

Additionally, the clothes treating apparatus 1 according to an embodiment of the present disclosure may include a drain line 97 for guiding water discharged from the drying device 80. The drain line 97 may guide condensed water generated on the heat exchanger of the drying device 80 to the outside of the drying device 80. The drain line 97 may guide the cleaning water injected by the nozzle device 96 to clean the heat exchanger to the outside of the drying device 80. The drain line 97 may be connected to the drainage device 70. The water discharged from the drying device 80 may flow to the drainage device 70 along the drain line 97. The water introduced into the drainage device 70 through the drain line 97 may be discharged to the outside of clothes treating apparatus 1.

The supply flow path 87 may be provided to supply heated air while passing through the condenser 92 back into the inside of the tub 20. The supply flow path 87 may be in communication with the heating flow path 86 and extend downward to discharge the heated air toward the opening of the tub 20.

A supply fan 87*a* may be provided in the supply flow path 87 to flow air into the inside of the tub 20. That is, the supply fan 87*a* may be provided to supply air to the laundry inside the drum 30. For example, the supply fan 87*a* may include a sirocco fan.

The inlet flow path 85, the heating flow path 86, and the supply flow path 87 may circulate air into the tub 20 and the drying device 80.

The clothes treating apparatus 1 according to an embodiment of the present disclosure may be provided such that the air discharged from the tub 20 sequentially passes through the inlet flow path 85, the heating flow path 86, and the supply flow path 87 of the drying device 80 located above the tub 20, and then is supplied into the tub 20.

The air heated in the drying device 80 may be supplied into the drum 30. In order to secure a region in which the heated air supplied into the drum 30 comes into contact with the laundry, a tub exhaust hole 27 may be provided in a position opposite to an air inlet 26 through which air heated in the drying device 80 is supplied to the tub 20. In order to increase a distance and/or time over which the heated air flows inside the drum 30 so that the heated air may come into greater contact with the laundry, the tub exhaust hole 27 may be provided in a position opposite to the air inlet 26 through which the air heated in the drying device 80 is supplied to the tub 20. The supply flow path 87 for allowing the heated air to be supplied into the drum 30 and the tub exhaust hole 27 may be disposed to be spaced apart from each other. By increasing a contact area between the heated air and laundry, the drying efficiency may be improved.

The air inlet 26 and the tub exhaust hole 27 according to an embodiment of the present disclosure may be disposed to maximize the use of heated air provided from the drying device 80. As an example, the air inlet 26 may be located adjacent to a front surface of the tub 20, and the tub exhaust hole 27 may be located adjacent to a rear surface of the tub 20.

The clothes treating apparatus 1 according to various embodiments may further include the exhaust flow path P through which the air discharged from the inside of the tub 20 flows to the drying device 80. The exhaust flow path P may be provided such that the air discharged from the tub exhaust hole 27 flows to the inlet flow path 85 of the drying device 80. The exhaust flow path P may be provided to discharge the moist air passed through the tub 20. As an example, the exhaust flow path P may be provided at the rear of the tub 20.

The air inside the tub 20 may be discharged into a tub duct 28 through the tub exhaust hole 27 formed on the rear surface of the tub 20. The air discharged from the tub duct 28 may flow along the exhaust flow path P and be supplied to the drying device 80.

The clothes treating apparatus 1 according to various embodiments may include the tub duct 28 forming at least a portion of the exhaust flow path P. As an example, the tub duct 28 may be formed integrally with the tub 20. As an example, the tub 20 may include the tub duct 28. The tub duct 28 may be provided to surround the tub exhaust hole 27.

The clothes treating apparatus 1 according to various embodiments may include a duct cover 29 forming at least a portion of the exhaust flow path P. The duct cover 29 may be provided to cover an open rear side of the tub duct 28. As an example, the tub 20 may include the duct cover 29. The duct cover 29 may form at least a portion of the exhaust flow path P through which the air discharged through the tub exhaust hole 27 flows to the drying device 80.

In the clothes treating apparatus 1 according to various embodiments, the exhaust flow path P may be formed as the duct cover 29 is coupled to the tub duct 28.

The tub duct 28 according to one embodiment may include a recess portion 28*a* forming a portion of the exhaust flow path P through which the air discharged from the inside of the tub 20 flows. Reinforcing ribs 23 may be provided on the rear surface of the tub 20 to reinforce the strength of the tub 20, and the recess portion 28*a* may be formed as a portion recessed from ends of the reinforcing ribs 23 protruding from the rear surface of the tub 20. The recess portion 28*a* may be provided in a portion of the rear surface of the tub 20 where the reinforcing ribs 23 are not formed. The tub exhaust hole 27 may be formed on the recess portion 28*a* to exhaust air from the inside of the tub 20. The tub duct 28 may include a partition rib 28*d* provided along a circumference of the recess portion 28*a*. The partition rib 28*d* may partition a region where the reinforcing rib 23 is formed and a region where the recess portion 28*a* is formed on the rear surface of the tub 20.

The tub duct 28 according to one embodiment may include a duct connection portion 28*b* forming another portion of the exhaust flow path P through which the air passed through the recess portion 28*a* flows. The duct connection portion 28*b* may protrude outward from an outer circumferential surface of the tub 20. The duct connection portion 28*b* may protrude substantially upward from the outer circumferential surface of the tub 20.

The duct connection portion 28*b* may communicate the drying device 80 and the recess portion 28*a*. The duct connection portion 28*b* may be connected to the inlet guide 84 of the drying device 80. The duct connection portion 28*b* may form one passage forming the exhaust flow path P together with the recess portion 28*a* and the duct cover 29.

The duct connection portion 28*b* may be covered by the duct cover 29. The duct connection portion 28*b* may have one open side. The duct cover 29 may cover the one open side of the duct connection portion 28*b*.

The duct cover 29 may cover both the recess portion 28*a* and the duct connection portion 28*b*. For example, the duct cover 29 may cover both an open side of the recess portion 28*a* and the open side of the duct connection portion 28*b*. The exhaust flow path P may be formed by the duct cover 29 covering the recess portion 28*a* and the duct connection portion 28*b*. As an example, the duct cover 29 may cover only the recess portion 28*a*.

The duct cover 29 may be provided to cover the open rear side of the recess portion 28*a* and/or the open rear side of the duct connection portion 28*b*. The exhaust flow path P may be one passage formed together with the tub duct 28 and the duct cover 29.

The tub duct 28 may include a step portion 28*c* to expand a cross-sectional area of the exhaust flow path P. The exhaust flow path P may be provided such that a width of a portion formed by the duct connection portion 28*b* is larger than a width of a portion formed in the recess portion 28*a* by the step portion 28*c*.

The arrangement positions of the water supply valves 41 and 42 of the clothes treating apparatus 1 according to an embodiment of the present disclosure may be determined by utilizing a space vacated by this mounting structure. In one embodiment of the present disclosure, the water supply valves 41 and 42 may be mounted between the inlet guide 84 and the cooling fan 91*a*. The water supply valves 41 and 42 may be located in a central portion of the rear surface of the drying device 80. The water supply valves 41 and 42 may be located at the rear of the condenser 92. The water supply valves 41 and 42 may be located in a region separated from a flow path through which dry air flows. However, the positions of the water supply valves 41 and 42 are not limited thereto.

Additionally, the clothes treating apparatus 1 according to an embodiment of the present disclosure may include a washing water heater 24. The washing water heater 24 may be provided below the tub 20 to heat washing water during washing. The water supply device 40 may supply a certain amount of water to a lower side of the tub 20 through the exhaust flow path P during the drying process, and the washing water heater 24 may generate steam by heating the water supplied into the tub 20 through the water supply device 40, the exhaust flow path P, and the tub exhaust hole 27. That is, the steam generated by the water supply device 40 and the washing water heater 24 may come into contact with clothes during the drying process, thereby maximally preventing wrinkles from forming on the clothes.

That is, the clothes treating apparatus 1 according to an embodiment of the present disclosure is a washing/drying combined washing machine and, unlike a conventional dryer, may include the washing water heater 24 for heating washing water, and may generate steam by utilizing the washing water heater 24 and the water supply device 40 for cleaning the exhaust flow path P, thereby maximally preventing wrinkles from forming on the clothes during the drying process.

Figure 6:
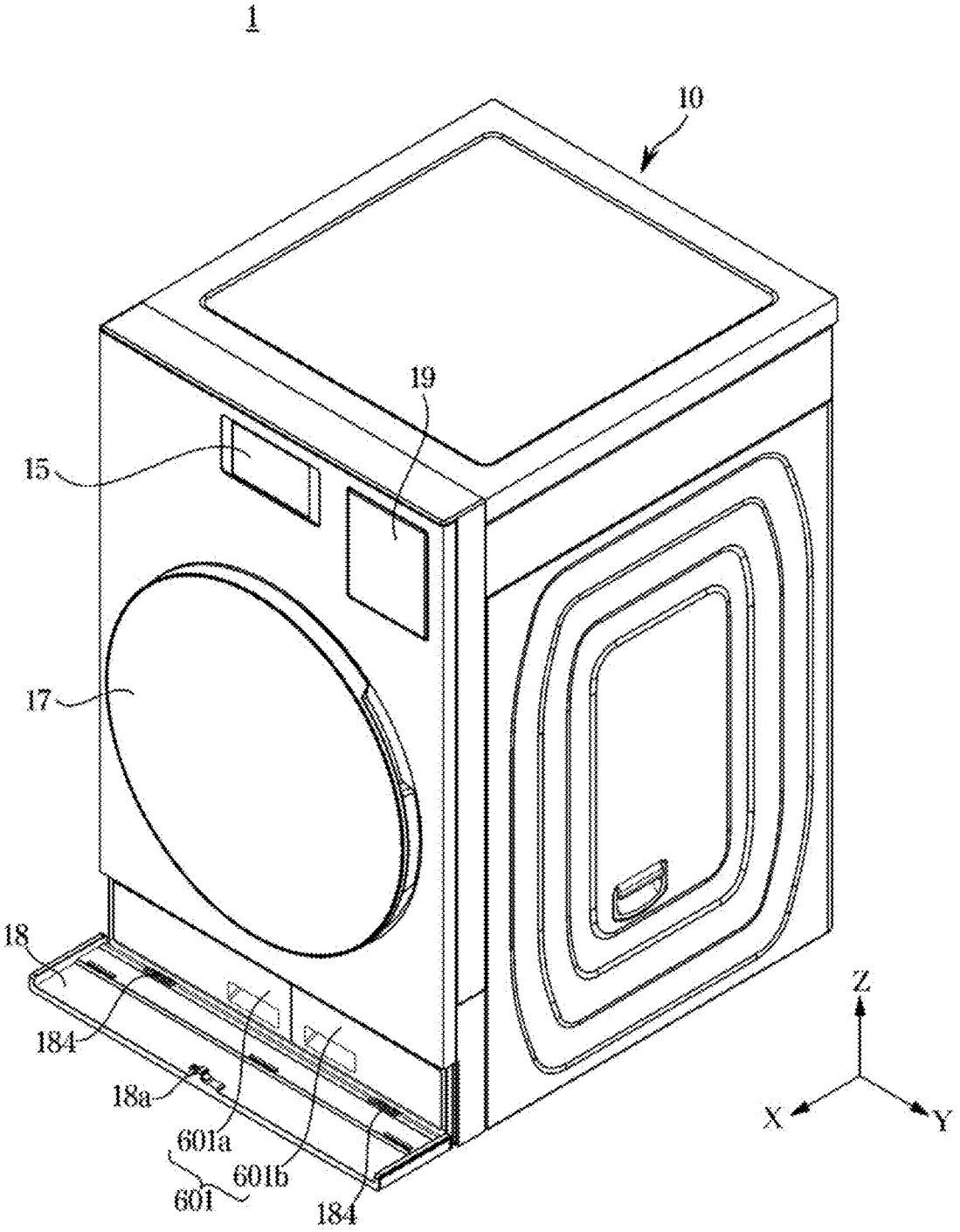
FIG. 6 illustrates a state in which a lower door is opened in the clothes treating apparatus according to an embodiment of the present disclosure.
Figure 7:
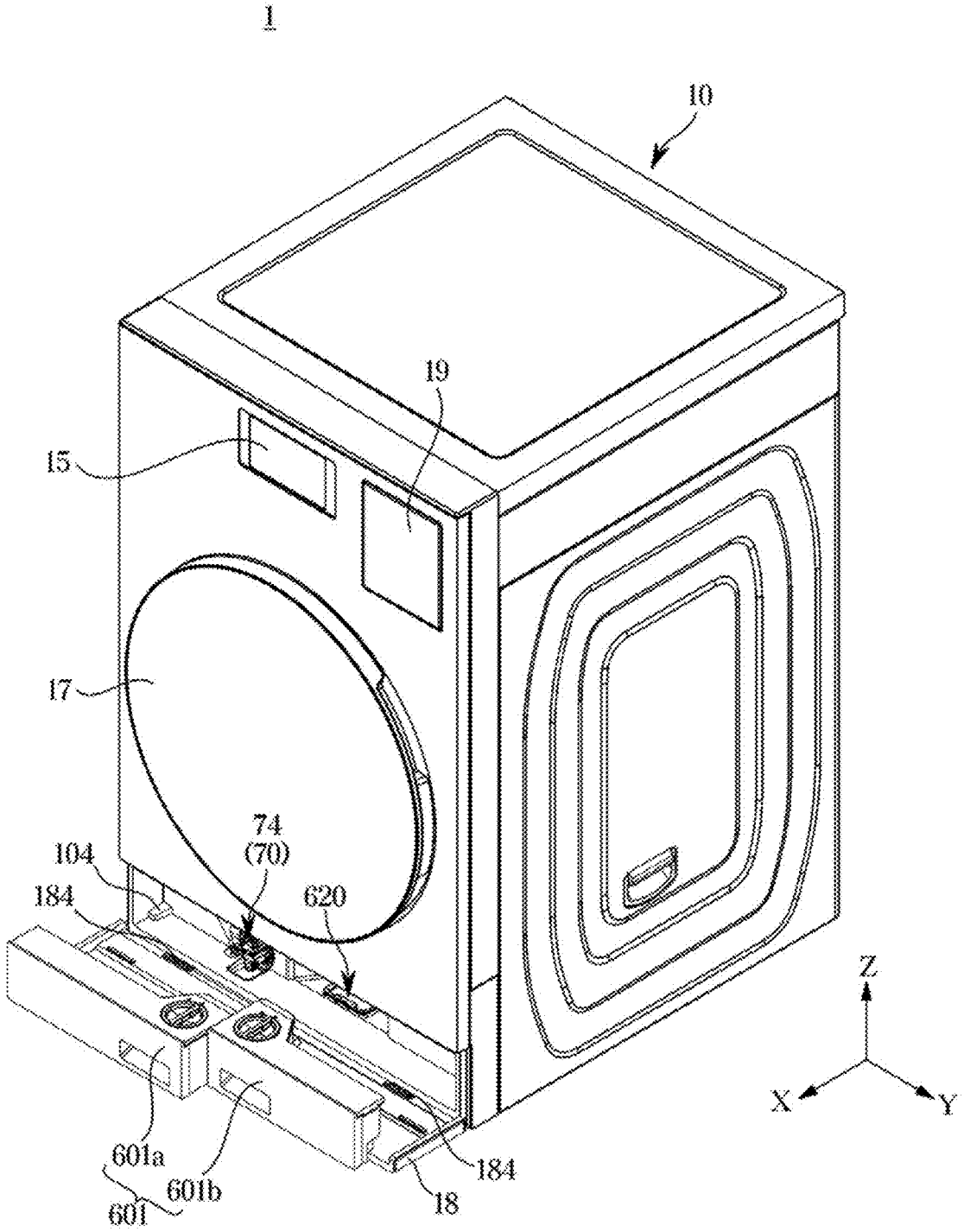
FIG. 7 illustrates a state in which a detergent box is separated from a housing in the clothes treating apparatus according to an embodiment of the present disclosure.
Figure 8:
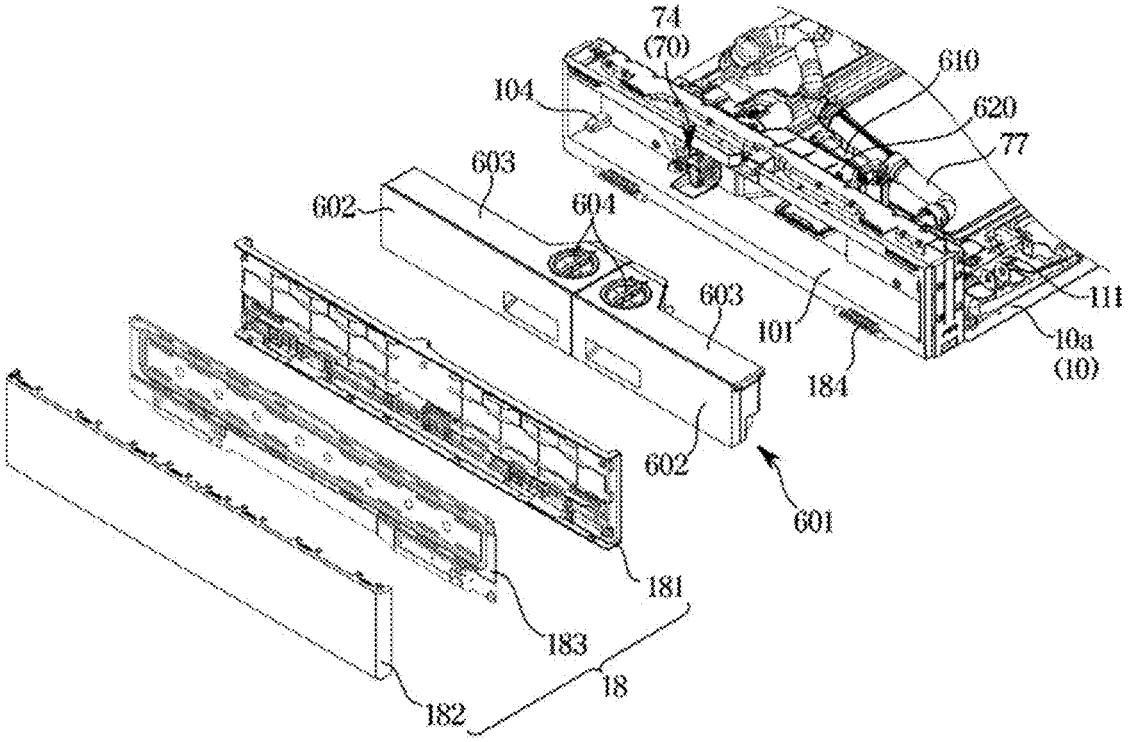
FIG. 8 illustrates the detergent box and some exploded components of the lower door which are separated from the housing in the clothes treating apparatus according to an embodiment of the present disclosure.

FIG. 6 illustrates a state in which a lower door is opened in the clothes treating apparatus according to an embodiment of the present disclosure. FIG. 7 illustrates a state in which a detergent box is separated from a housing in the clothes treating apparatus according to an embodiment of the present disclosure. FIG. 8 illustrates the detergent box and some exploded components of the lower door which are separated from the housing in the clothes treating apparatus according to an embodiment of the present disclosure.

Hereinafter, for convenience of explanation, the lower detergent supply device 60 may be referred to as the detergent supply device 60.

Referring to FIGS. 6 to 8, the clothes treating apparatus 1 according to an embodiment of the present disclosure may be provided such that the detergent supply device 60 is accessible to the user as the lower door 18 is opened. As an example, the lower door 18 may be rotatably mounted on the housing 10. The lower door 18 may be provided such that a lower end thereof is rotatably coupled to the housing 10, and may be rotated with respect to the housing 10 about the lower end as a rotation axis. The lower door 18 may be provided to cover a detergent box 601 when the detergent box 601 is mounted in the housing 10.

The lower door 18 may include a door latch 18*a* fixed to the housing 10 so as not to be opened when the lower door 18 is in a position to cover the detergent supply device 60.

As an example, the clothes treating apparatus 1 may include a lower door opening and closing device configured to lock or unlock the door latch 18*a*. For example, as a portion of the lower door 18 where the door latch 18*a* is located is pressed toward the lower door opening and closing device when the lower door 18 is closed in a state of being opened, the door latch 18*a* may be coupled to the lower door opening and closing device, and as the portion of the lower door 18 where the door latch 18*a* is located is pressed toward the lower door opening and closing device when the lower door 18 is opened in a state of being closed, the door latch 18*a* may be separated from the lower door opening and closing device.

Referring to FIG. 8, the lower door 18 may include a door body 181 and a door cover 182 coupled to the front of the door body 181. Unlike that shown in FIG. 8, the lower door 18 may include the door body 181 and the door cover 182 formed integrally.

As an example, the lower door 18 may include a door reinforcing part 183 to reinforce the strength of the lower door 18. The door reinforcing part 183 may include a material with greater strength than the door body 181 and/or the door cover 182.

The clothes treating apparatus 1 may include a door hinge 184 provided to rotatably mount the lower door 18 to the housing 10. The door hinge 184 may be fixed to the housing 10, and the lower door 18 may be rotatably coupled to the door hinge 184. As an example, the door hinge 184 may be fixed to a lower frame 101 and/or a lower bracket 106 of the housing 10. The door hinge 184 may be provided to support rotation of the lower door 18.

The detergent supply device 60 of the clothes treating apparatus 1 may include the detergent box 601 provided to accommodate the detergent. The detergent box 601 may be detachably mounted on the lower frame 101. The detergent box 601 may be provided to be accessible to the user as the lower door 18 is opened.

As an example, the detergent box 601 may include a first detergent box 601*a* and a second detergent box 601*b*. The first detergent box 601*a* and the second detergent box 601*b* may be used to store different detergents, or may be used to store the same detergent.

The detergent box 601 may include a detergent box body 602 and a detergent box cover 603 detachably coupled to the detergent box body 602. The detergent box body 602 may have a box shape with an open upper end, and the detergent box cover 603 may be provided to cover the open upper side of the detergent box body 602.

The detergent box 601 may include a detergent box lid 604 provided to cover an opening for supplying the detergent to the inside of the detergent box 601 when the detergent box cover 603 is coupled to the detergent box body 602. The opening may be formed on the detergent box cover 603 to supply the detergent to the detergent box 601, and the detergent box lid 604 may be provided to cover the opening formed on the detergent box cover 603.

Figure 9:
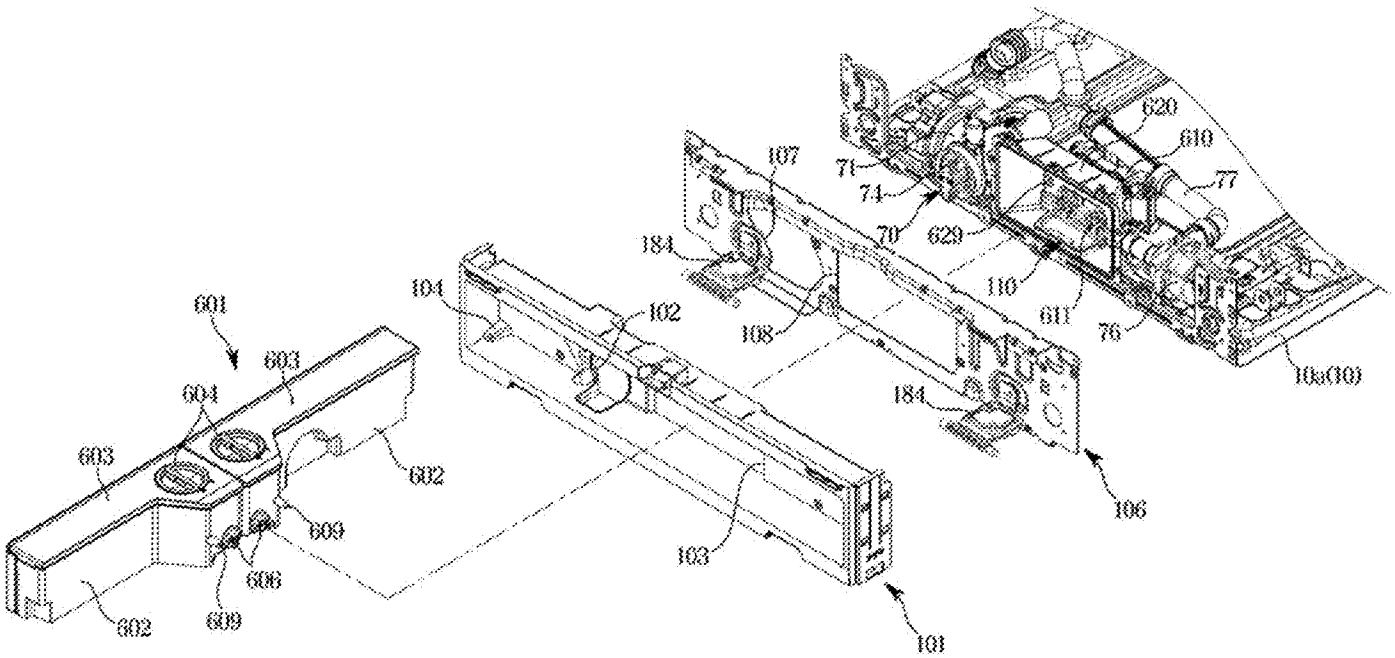
FIG. 9 illustrates some exploded components of the housing in the clothes treating apparatus according to an embodiment of the present disclosure.

FIG. 9 illustrates some exploded components of the housing in the clothes treating apparatus according to an embodiment of the present disclosure.

Referring to FIG. 9, the housing 10 of the clothes treating apparatus 1 according to an embodiment of the present disclosure may include the lower frame 101 and the lower bracket 106. The lower frame 101 and the lower bracket 106 may be provided as separate components, but are not limited thereto, and the lower frame 101 and the lower bracket 106 may be provided integrally.

The lower frame 101 may be provided to cover the front of a detergent supply module 110 mounted on a bottom plate 10*a*. The lower frame 101 may be provided in front of the detergent supply module 110 to mount the detergent box 601. The lower frame 101 may form a space to accommodate the detergent box 601. The lower frame 101 may be coupled to the front of the lower bracket 106. The door hinge 184 may be mounted on the lower frame 101.

The drainage device 70 may include a drain filter 74 provided to filter out foreign substances from water passing through the drainage device 70. The lower frame 101 may include a filter opening 102 through which the drain filter 74 of the drainage device 70 may pass. When the detergent box 601 is separated from the lower frame 101, the drain filter 74 may be exposed to the outside. In a state in which the detergent box 601 is separated from the lower frame 101, the user may access the drain filter 74 to maintain and/or repair the drain filter 74.

The lower frame 101 may include a detergent box opening 103 through which a portion of the detergent box 601 may pass. When the detergent box 601 is mounted on the lower frame 101, a portion of the detergent box 601 may pass through the detergent box opening 103 to be connected to the detergent supply module 110.

The lower frame 101 may include a detergent box guide 104 to guide the detergent box 601 to a mounting position when the detergent box 601 is mounted. The detergent box guide 104 may be formed with a portion protruding from the inner space of the lower frame 101 for accommodating the detergent box 601. The detergent box 601 may be mounted on the lower frame 101 while being guided by the detergent box guide 104.

The lower bracket 106 may be mounted on the bottom plate 10*a* of the housing 10. The lower bracket 106 may be provided to cover the front of the detergent supply module 110. The door hinge 184 may be mounted on the lower bracket 106. As an example, the lower bracket 106 may include a material with greater strength than the lower frame 101. The lower bracket 106 may be provided between the detergent supply module 110 and the lower frame 101.

The lower bracket 106 may include a filter passing portion 107 formed to be accessible to the drain filter 74 of the drainage device 70. The filter passing portion 107 may be provided at a position corresponding to the filter opening 102. As an example, the filter passing portion 107 may be provided with a size equal to or larger than the filter opening 102.

The lower bracket 106 may include a detergent box passing portion 108 through which a portion of the detergent box 601 may pass. The detergent box passing portion 108 may be provided at a position corresponding to the detergent box opening 103. As an example, the detergent box passing portion 108 may be provided with a size equal to or larger than the detergent box opening 103.

Figure 10:
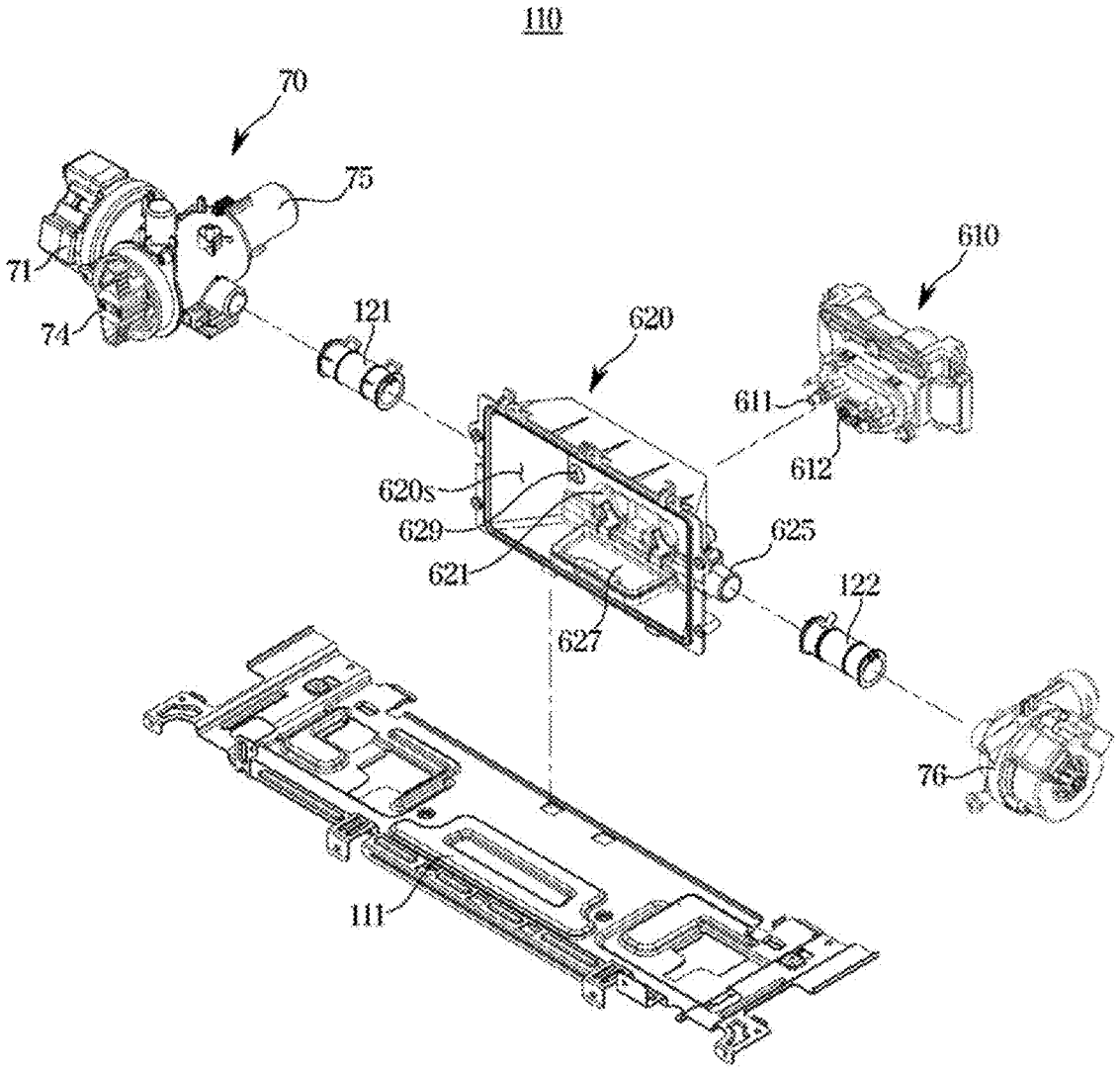
FIG. 10 is an exploded view of a detergent supply module in the clothes treating apparatus according to an embodiment of the present disclosure.
Figure 11:
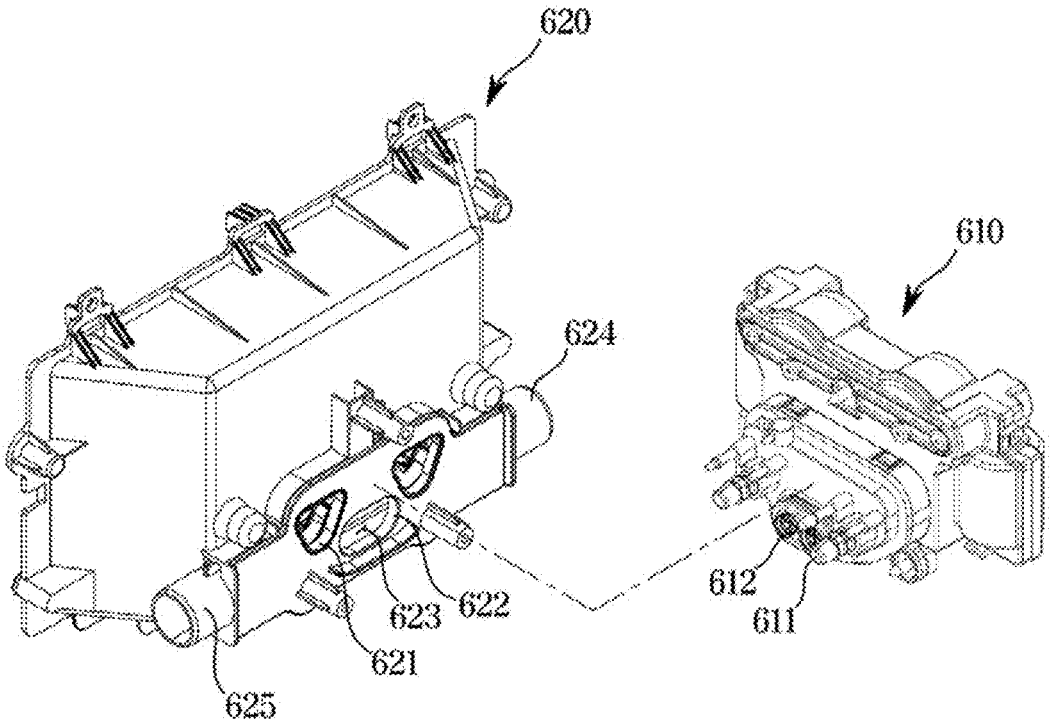
FIG. 11 illustrates a coupling relationship between a mixing case and a detergent pump of the detergent supply module according to an embodiment of the present disclosure.
Figure 12:
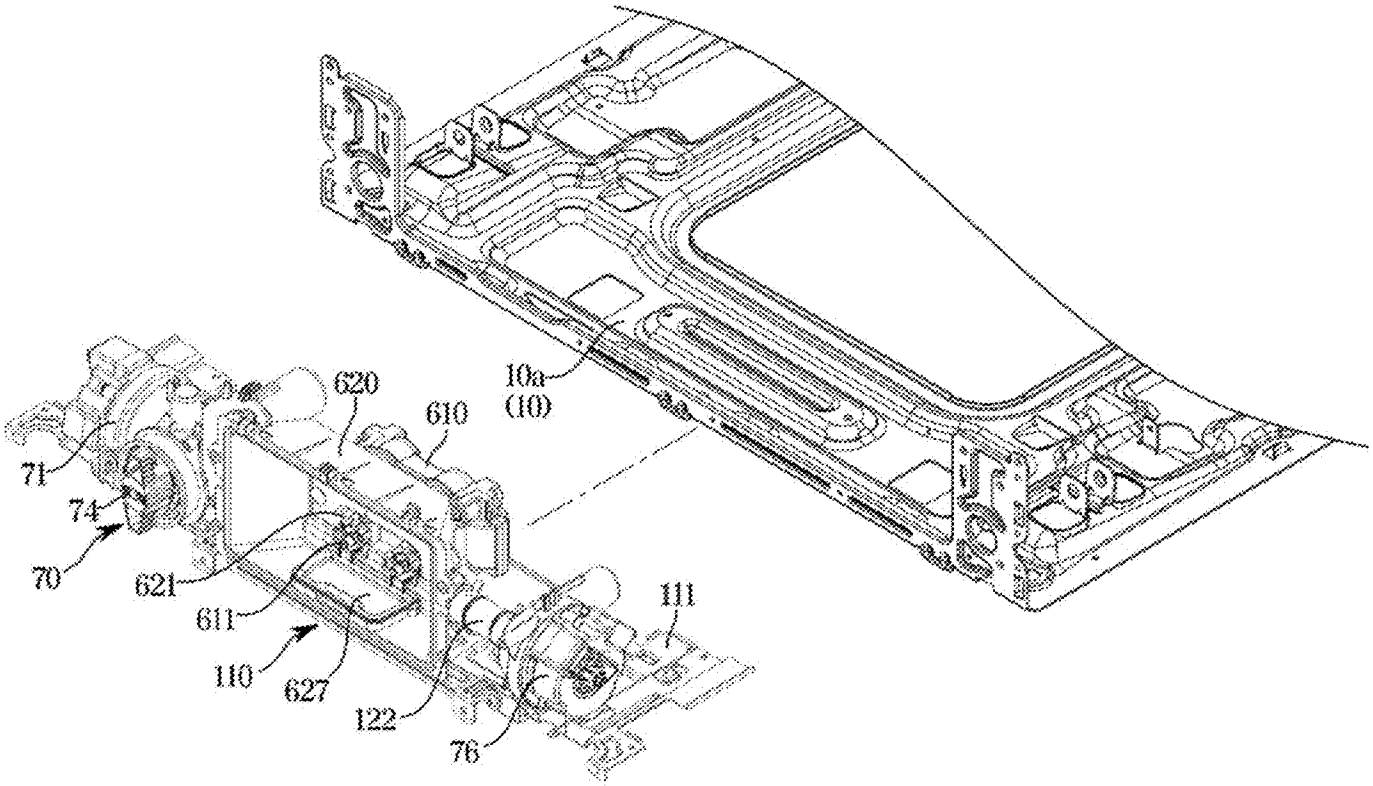
FIG. 12 illustrates that the detergent supply module is being mounted in the housing in the clothes treating apparatus according to an embodiment of the present disclosure.

FIG. 10 is an exploded view of a detergent supply module in the clothes treating apparatus according to an embodiment of the present disclosure. FIG. 11 illustrates a coupling relationship between a mixing case and a detergent pump of the detergent supply module according to an embodiment of the present disclosure. FIG. 12 illustrates that the detergent supply module is being mounted in the housing in the clothes treating apparatus according to an embodiment of the present disclosure.

Referring to FIG. 10, the detergent supply device 60 of the clothes treating apparatus 1 may include a detergent pump 610 connectable to the detergent box 601, and a mixing case 620 in which the detergent pump 610 is mounted. The detergent pump 610 may be located at the rear of the mixing case 620. The mixing case 620 may be connected to the drain pump 71 of the drainage device 70. The mixing case 620 may be connected to the circulation pump 76. The mixing case 620 may include a detergent box space 620*s* for accommodating a portion of the detergent box 601 when the detergent box 601 is mounted in the housing 10.

The drain pump 71 of the drainage device 70 may be provided to discharge the water discharged from the tub 20 into the mixing case 620 or to the outside of the housing 10.

The clothes treating apparatus 1 according to an embodiment of the present disclosure may be provided with the components for automatically supplying the detergent to the tub 20 as a single module. As an example, the clothes treating apparatus 1 may be provided with the drainage device 70, the circulation pump 76, the detergent pump 610, and the mixing case 620 as a single module. The clothes treating apparatus 1 may include the detergent supply module 110 in which the drainage device 70, the circulation pump 76, the detergent pump 610, and the mixing case 620 are provided as a single module. The detergent supply module 110 may be provided to supply the detergent to the washing water to be supplied to the tub 20. The detergent supply module 110 may be disposed below the tub 20. The detergent supply module 110 may be detachably mounted in the housing 10.

The detergent supply module 110 may include a base frame 111 to be mounted on the bottom plate 10*a* of the housing 10. The drainage device 70, the circulation pump 76, the detergent pump 610, and the mixing case 620 may be mounted on the base frame 111. The detergent supply module 110 may be provided as a single module as the drainage device 70, the circulation pump 76, the detergent pump 610, and the mixing case 620 are mounted on the base frame 111. The detergent supply module 110, which is provided as a single module, may be simply separated from the bottom plate 10*a* for maintenance and/or repair, and may be easily mounted on the bottom plate 10*a*.

The drain pump 71 of the drainage device 70 and the circulation pump 76 may be mounted on the base frame 111. The mixing case 620 may be mounted on the base frame 111 between the drain pump 71 of the drainage device 70 and the circulation pump 76.

Referring to FIGS. 9 and 10, the mixing case 620 may include a guide coupling portion 629 for guiding the mounting of the detergent box 601 so that the detergent box 601 may be docked with the detergent pump 610. At least a portion of the detergent box 601 may be accommodated in the mixing case 620 when the detergent box is mounted on the lower frame 101 of the housing 10, and the detergent box 601 may include a docking guide 609 to be coupled to the guide coupling portion 629 when the at least a portion is accommodated in the mixing case 620. As an example, the docking guide 609 may have a protruding shape and the guide coupling portion 629 may have a groove shape, but is not limited thereto, and the docking guide 609 may have a groove shape and the guide coupling portion 629 may have a protruding shape. The guide coupling portion 629 of the mixing case 620 may be coupled to the docking guide 609 when the detergent box 601 is mounted in the housing 10 to guide docking of a detergent intake portion 611 and a docking portion 606.

The detergent pump 610 may be provided to be docked with the detergent box 601. The detergent intake portion 611 of the detergent pump 610 may be docked with the docking portion 606 of the detergent box 601. When the detergent intake portion 611 of the detergent pump 610 is docked with the docking portion 606 of the detergent box 601, the detergent pump 610 may intake the detergent stored in the detergent box 601.

Referring to FIGS. 10 and 11, the mixing case 620 may include an intake opening 621 through which the detergent intake portion 611 of the detergent pump 610 may pass. The detergent pump 610 may be provided such that the detergent intake portion 611 passes through the intake opening 621 and is located in a detergent box space 620*s* for accommodating a portion of the detergent box 601 of the mixing case 620 when the detergent pump is mounted at the rear of the mixing case 620. The detergent intake portion 611 may be connected to the detergent box 601 to intake the detergent from the detergent box 601 as the detergent intake portion is located in the detergent box space 620*s* for accommodating a portion of the detergent box 601.

The mixing case 620 may include a discharge opening 622 into which a detergent discharge portion 612 of the detergent pump 610 may be inserted. When mounted on the mixing case 620, the detergent pump 610 may discharge the detergent to a mixing flow path 623 formed on the mixing case 620 through the discharge opening 622. The detergent pump 610 may supply the detergent to the mixing flow path 623. The mixing flow path 623 may be provided between a mixing inlet 624 and a mixing outlet 625.

The mixing case 620 may include a detachable tray 627. When the docking of the detergent pump 610 and the detergent box 601 is released, the remaining detergent or mixed water in the detergent intake portion 611 may fall down. At this time, the remaining detergent or mixed water falls into the tray 627, and the user may separate and clean only the tray 627.

The mixing case 620 may be connected to the drainage device 70. The mixing case 620 may include the mixing inlet 624 to be connected to the drain pump 71 of the drainage device 70. The detergent supply module 110 may include a drain connection pipe 121 to connect the drain pump 71 of the drainage device 70 and the mixing case 620. One end of the drain connection pipe 121 may be connected to the drainage device 70, and the other end of the drain connection pipe 121 may be connected to the mixing case 620. As the drain connection pipe 121 connects the mixing inlet 624 of the mixing case 620 and the drainage device 70, the water discharged from the drainage device 70 may flow into the mixing flow path 623 of the mixing case 620.

The mixing case 620 may be connected to the circulation pump 76. The mixing case 620 may include the mixing outlet 625 to be connected to the circulation pump 76. The detergent supply module 110 may include a circulation connection pipe 122 to connect the circulation pump 76 and the mixing case 620. One end of the circulation connection pipe 122 may be connected to the circulation pump 76, and the other end of the circulation connection pipe 122 may be connected to the mixing case 620. As the circulation connection pipe 122 connects the mixing outlet 625 of the mixing case 620 and the circulation pump 76, the water or water mixed with the detergent discharged from the mixing case 620 may flow to the circulation pump 76.

The mixing case 620 may include the mixing flow path 623 formed to mix the detergent discharged from the detergent discharge portion 612 of the detergent pump 610 and the water introduced through the mixing inlet 624. The mixing flow path 623 may extend between the mixing inlet 624 and the mixing outlet 625. The mixing flow path 623 may form a portion of a flow path for the water discharged from the drainage device 70 to flow to the circulation pump 76. The mixing flow path 623 may be partitioned from the detergent box space 620*s* of the mixing case 620 for accommodating a portion of the detergent box 601.

The detergent pump 610 may intake the detergent stored in the detergent box 601 and discharge the intaken detergent into the flow path for the water discharged from the drainage device 70 of the mixing case 620 to flow to the circulation pump 76.

The detergent pump 610 may be provided to be connectable to the detergent box 601 and may include the detergent intake portion 611 for intaking the detergent stored in the detergent box 601. The detergent intake portion 611 may be located in the detergent box space 620*s* when the detergent pump 610 is mounted on the mixing case 620.

The detergent pump 610 may include the detergent discharge portion 612 to be inserted into the discharge opening 622 of the mixing case 620 so that the detergent is discharged into the mixing flow path 623 formed on the mixing case 620. The detergent discharge unit 612 may be located in the mixing flow path 623 when the detergent pump 610 is mounted on the mixing case 620.

As an example, the detergent supply module 110 may be assembled as the detergent pump 610 is mounted on the mixing case 620, the mixing case 620, on which the drainage device 70, the circulation pump 76, and the detergent pump 610 are mounted, is mounted on the base frame 111, the drain connection pipe 121 is connected to the drainage device 70 and the mixing case 620, and the circulation connection pipe 122 is connected to the circulation pump 76 and the mixing case 620.

Referring to FIG. 12, the detergent supply module 110 assembled as a single module may be mounted on the bottom plate 10*a* of the housing 10. As an example, the detergent supply module 110 may be mounted in the housing 10 as the base frame 111 is mounted on the bottom plate 10*a* of the housing 10 and at least one fastening member is fastened.

Referring to FIG. 9, as the detergent supply module 110 is mounted on the bottom plate 10*a* of the housing 10 and the lower bracket 106 is mounted on the bottom plate 10*a*, a portion of the front of the detergent supply module 110 may be covered. After the lower bracket 106 is mounted on the bottom plate 10*a*, the lower frame 101 may be mounted on the lower bracket 106.

For example, when maintenance and/or repair of the detergent supply module 110 is required, as the lower frame 101 and the lower bracket 106 are sequentially separated from the bottom plate 10*a* and then the fastening members fastened to the detergent supply module 110 and the bottom plate 10*a* are disassembled, the detergent supply module 110 may be separated from the bottom plate 10*a*.

The mixing case 620 and the detergent pump 610 may be disposed between the drain pump 71 and the circulation pump 76. In this case, the drain pump 71, the mixing case 620, the detergent pump 610, and the circulation pump 76 may be arranged side by side in a line, and the connection pipe connecting the drain pump 71, the mixing case 620, and the circulation pump 76 may be provided with a minimum length. Accordingly, the detergent supply module 110 may be compactly configured to be mounted on the one bottom plate 10*a*.

Figure 13:
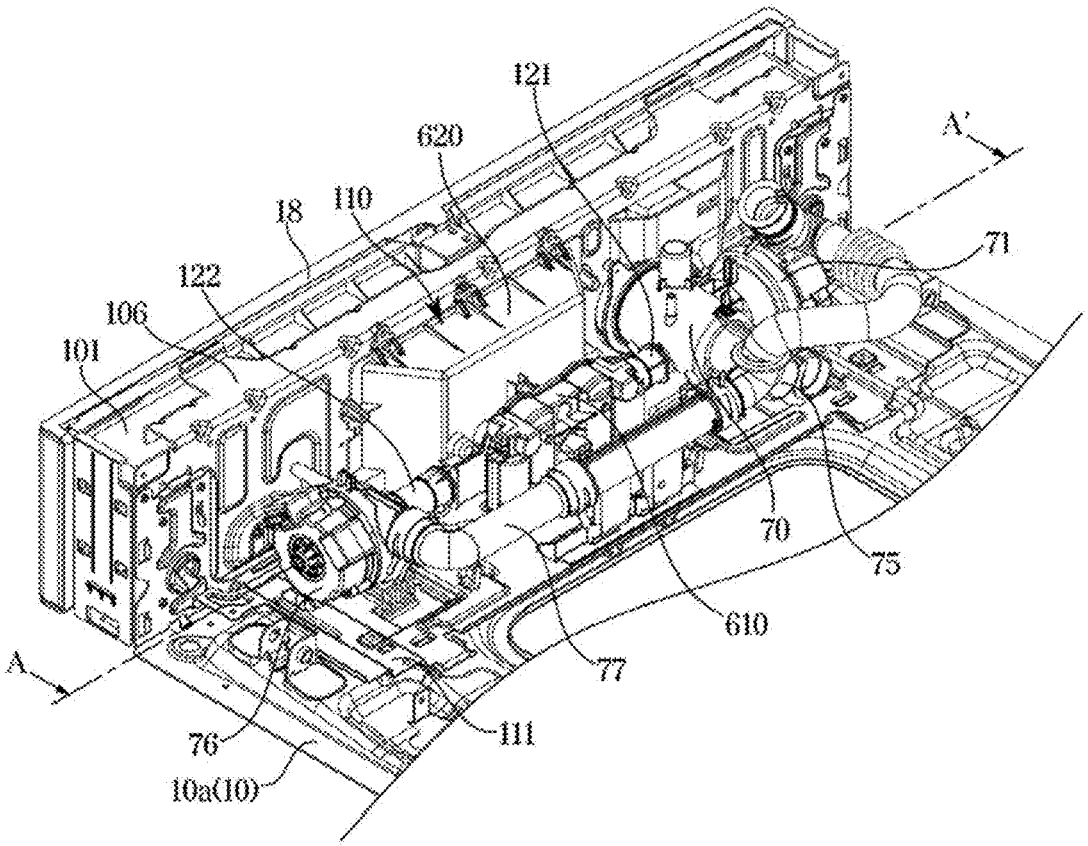
FIG. 13 illustrates that the detergent supply module is mounted in the housing in the clothes treating apparatus according to an embodiment of the present disclosure, which is viewed from the rear.
Figure 14:
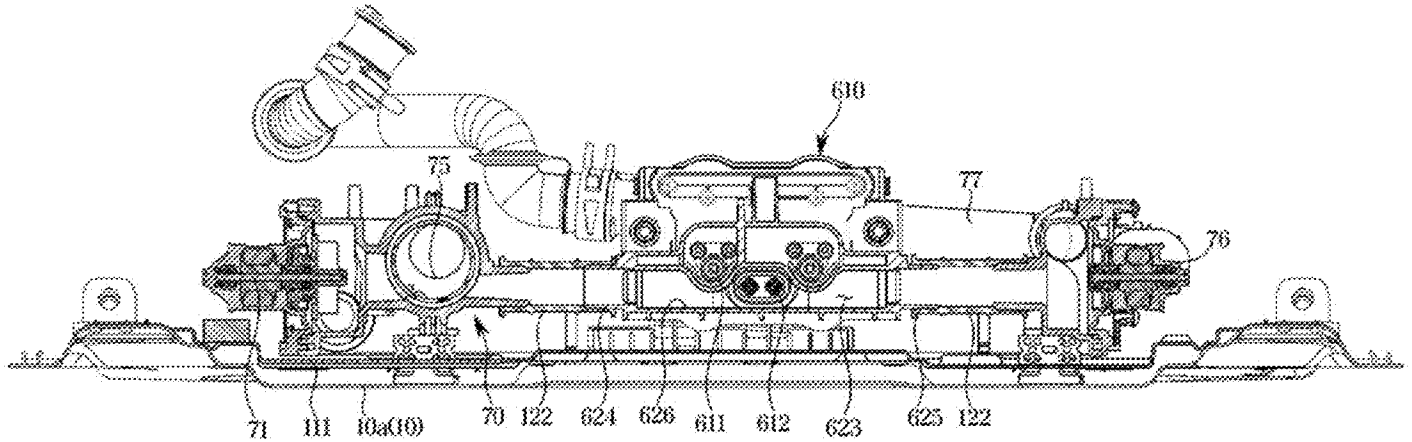
FIG. 14 illustrates a cross section taken along line A-A' indicated in FIG. 13.

FIG. 13 illustrates that the detergent supply module is mounted in the housing in the clothes treating apparatus according to an embodiment of the present disclosure, which is viewed from the rear. FIG. 14 illustrates a cross section taken along line A-A' indicated in FIG. 13.

A process of supplying the detergent to the tub 20 by the detergent supply module 110 will be described below with reference to FIGS. 13 and 14.

Referring to FIGS. 2 and 13, the tub 20 may be connected to the drainage device 70 through the tub connection pipe 72. The tub connection pipe 72 may be connected to a drain inlet 75 of the drainage device 70. Water in the tub 20 may flow to the drainage device 70 through the tub connection pipe 72.

Referring to FIGS. 13 and 14, the water introduced into the drainage device 70 may flow toward the mixing case 620 as the circulation pump 76 operates. The water discharged from the drainage device 70 may flow into the mixing case 620 through the drain connection pipe 121.

The water introduced into the mixing case 620 through the drain connection pipe 121 may flow along the mixing flow path 623. While the water flows in the mixing flow path 623, the detergent pump 610 may intake the detergent from the detergent box 601 and discharge the intaken detergent into the mixing flow path 623. The detergent pump 610 may be provided to discharge the detergent intaken through the detergent intake portion 611 to the mixing flow path 623 through the detergent discharge portion 612. The detergent discharged to the mixing flow path 623 by the detergent pump 610 may be mixed with the water flowing in the mixing flow path 623.

The water introduced through the drain connection pipe 121 may wash out the detergent discharge portion 612 while passing through the mixing flow path 623. Accordingly, the detergent may be prevented from remaining and sticking on the detergent discharge portion 612.

The water and detergent mixed in the mixing flow path 623 may be discharged into the circulation connection pipe 122. The water and detergent passed through the circulation connection pipe 122 may flow to the circulation guide 77 by the detergent pump 76. The circulation guide 77 may connect the circulation pump 76 and the tub 20. The circulation guide 77 may extend from the circulation pump 76 to the tub 20. The water and detergent may be supplied to the tub 20 by the circulation guide 77. The circulation pump 76 may be configured to supply the water and detergent in the mixing flow path 623 of the mixing case 620 to the tub 20 through the circulation guide 77.

For example, the clothes treating apparatus 1 may be provided such that a bottom surface 626 of the mixing flow path 623 is located at a lower height than a height of the mixing inlet 624 and/or the mixing outlet 625. As the bottom surface 626 of the mixing flow path 623 is located at a lower height than the height of the mixing inlet 624 and/or the mixing outlet 625, there may be residual water in the mixing flow path 623, and lint may be prevented from accumulating in the mixing flow path 623 by the residual water.

For example, the clothes treating apparatus 1 may be provided such that the bottom surface 626 of the mixing flow path 623 is located at the same height as the mixing inlet 624 and/or the mixing outlet 625. As the bottom surface 626 of the mixing flow path 623 is located at the same height as the mixing inlet 624 and/or the mixing outlet 625, a hydraulic loss of water sequentially passing through the mixing inlet 624, the mixing flow path 623, and the mixing outlet 625 may be minimized, and there may be residual water in at least a portion of the mixing flow path 623, thereby preventing lint from accumulating in the mixing flow path 623.

In addition, as the clothes treating apparatus 1 operates the circulation pump 76 even when performing a process of not supplying the detergent, water may flow in the mixing flow path 623 of the mixing case 620, so that the mixing flow path 623 of the mixing case 620 may be washed and kept clean.

Figure 15:
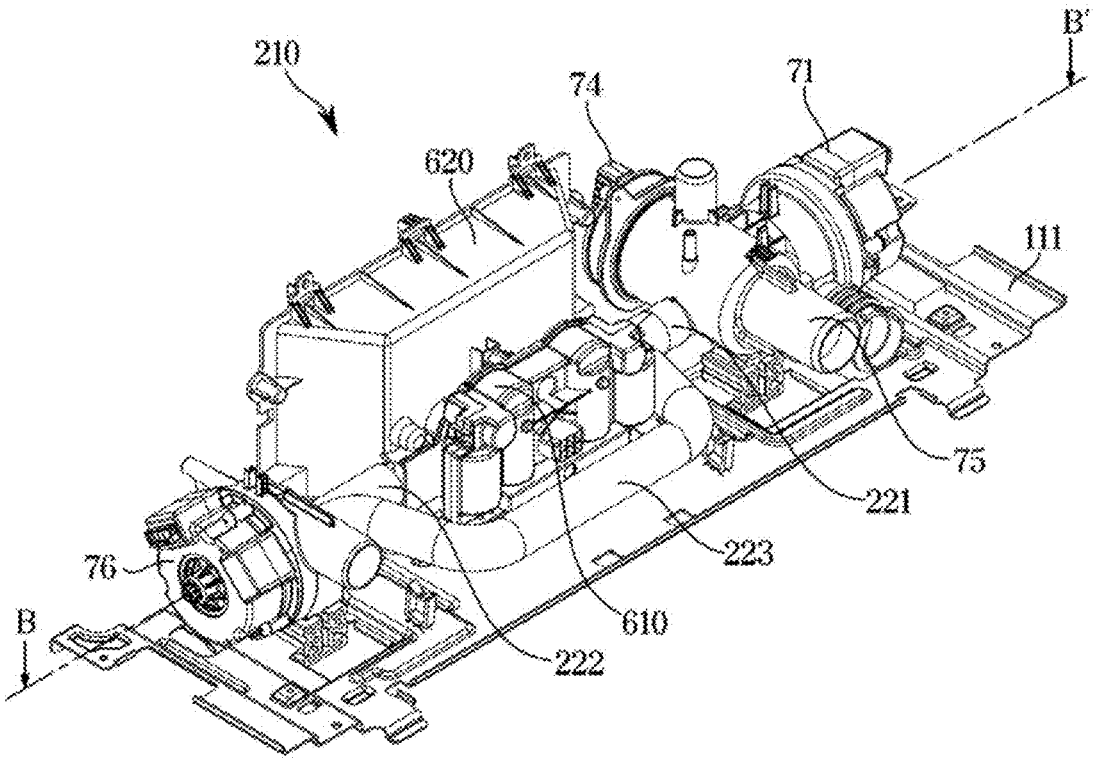
FIG. 15 illustrates the detergent supply module according to an embodiment of the present disclosure, which is viewed from the rear.
Figure 16:
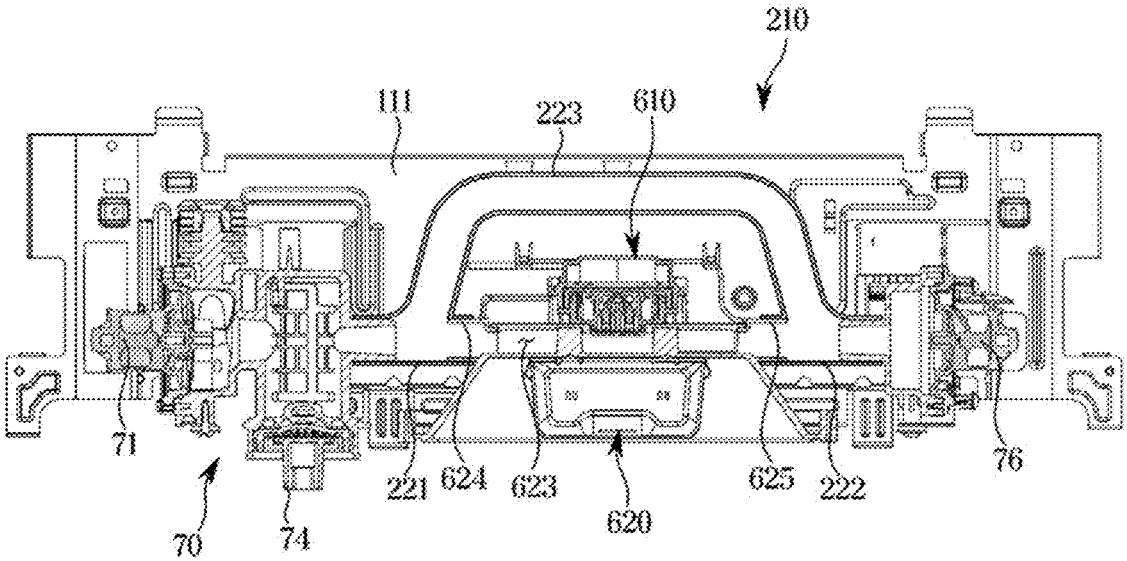
FIG. 16 illustrates a cross section taken along line B-B' indicated in FIG. 15.

FIG. 15 illustrates the detergent supply module according to an embodiment of the present disclosure, which is viewed from the rear. FIG. 16 illustrates a cross section taken along line B-B' indicated in FIG. 15.

Referring to FIGS. 15 and 16, a detergent supply module 210 may include the drainage device 70, the circulation pump 76, the detergent pump 610, and the mixing case 620 as the same configuration as the drainage device 70, the circulation pump 76, the detergent pump 610, and the mixing case 620 of the detergent supply module 110 illustrated in FIG. 13. Referring to FIGS. 15 and 16, the detergent supply module 210, unlike the drain connection pipe 121 and the circulation connection pipe 122 of the detergent supply module 110 illustrated in FIG. 13, may include a drain connection part 221, a circulation connection part 222, and a branch part 223.

Referring to FIGS. 15 and 16, the detergent supply module 210 may include the drain connection part 221 connecting the drain pump 71 of the drainage device 70 and the mixing case 620, the circulation connection part 222 connecting the mixing case 620 and the circulation pump 76, and the branch part 223 provided to connect the drain connection part 221 and the circulation connection part 222 and bypass the mixing case 620. As an example, the drain connection part 221, the circulation connection part 222, and the branch part 223 may be formed integrally.

The drain connection part 221 may extend between the drain pump 71 of the drainage device 70 and the mixing case 620. The drain connection part 221 may guide the water discharged from the drainage device 70 to the mixing case 620. A flow path may be formed inside the drain connection part 221 to allow the water discharged from the drainage device 70 to flow into the mixing case 620.

The circulation connection part 222 may extend between the mixing case 620 and the circulation pump 76. The circulation connection part 222 may guide the water and/or the detergent discharged from the mixing case 620 to the circulation pump 76. A flow path may be formed inside the circulation connection part 222 to allow the water discharged from the mixing case 620 to flow to the circulation pump 76.

The branch part 223 may extend from a portion of the drain connection part 221 to a portion of the circulation connection part 222. The branch part 223 may guide to prevent at least a portion of the water flowing from the drain pump 71 of the drainage device 70 to the circulation pump 76 from passing through the mixing case 620. The branch part 223 may be branched from a portion of the drain connection part 221. The branch part 223 may be provided such that only a portion of the water discharged from the drainage device 70 may flow.

For example, the branch part 223 may be provided to have the same height as the drain connection part 221 and the circulation connection part 222. The branch part 223 may be located on the same horizontal plane as the drain connection part 221 and the circulation connection part 222. With this structure, the detergent supply module 210 according to an embodiment of the present disclosure may minimize a hydraulic loss of water flowing from the drainage device 70 to the circulation pump 76, and because there may be residual water in the branch part 223, lint may be prevented from accumulating in the branch part.

Figure 17:
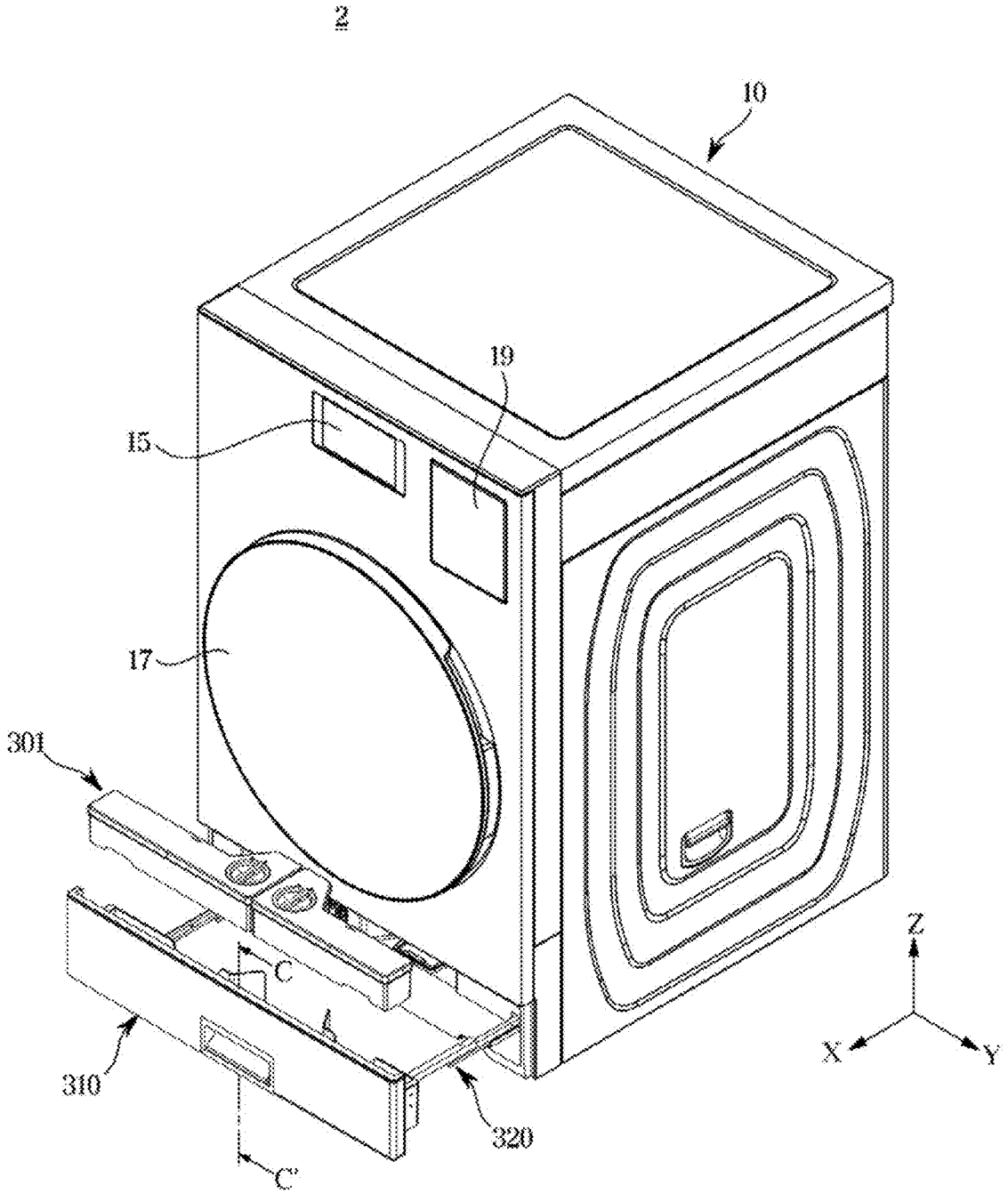
FIG. 17 illustrates a state in which the lower door is opened in the clothes treating apparatus according to an embodiment of the present disclosure.
Figure 18:
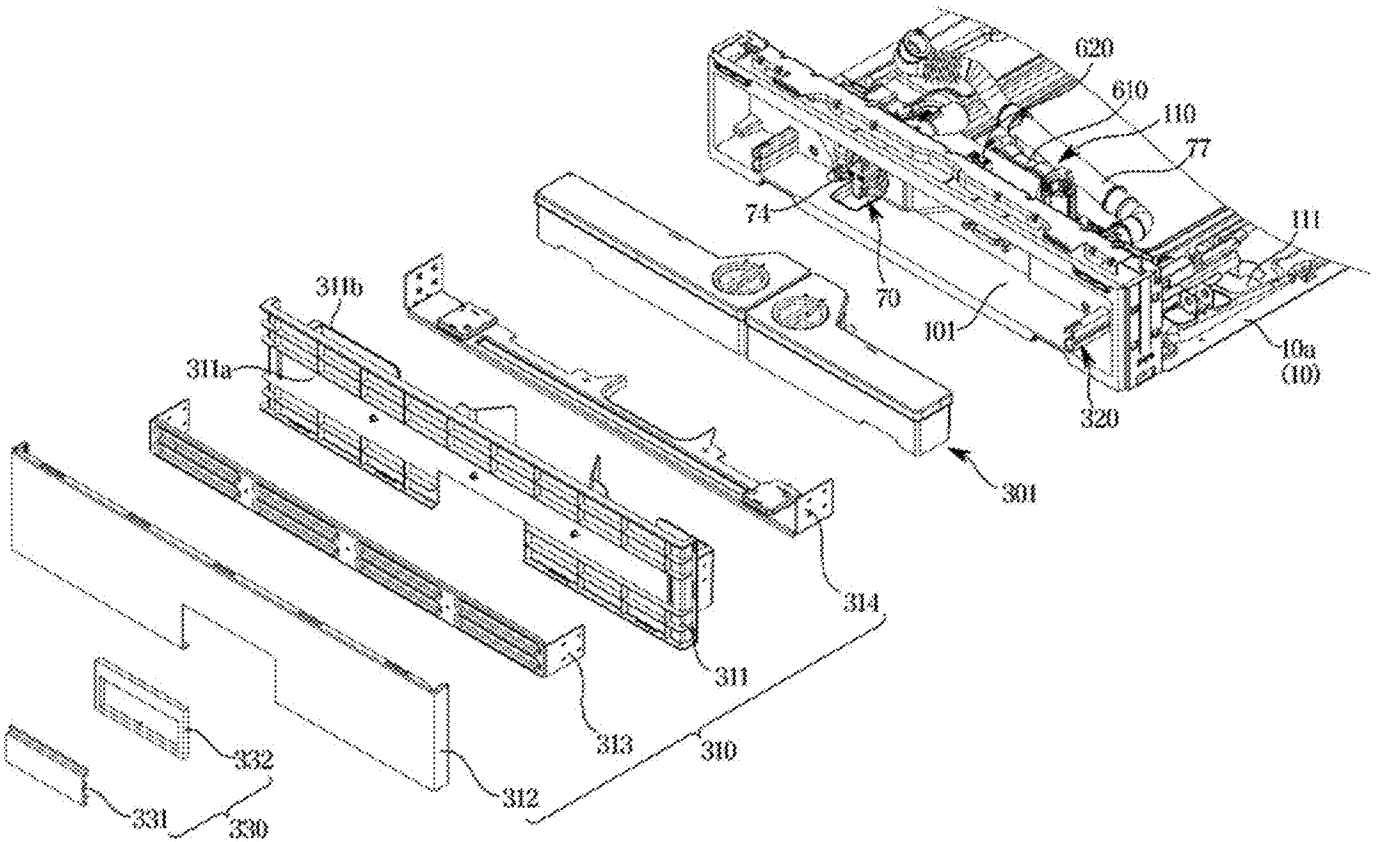
FIG. 18 illustrates the detergent box and some exploded components of the lower door which are separated from the housing in the clothes treating apparatus according to an embodiment of the present disclosure.
Figure 19:
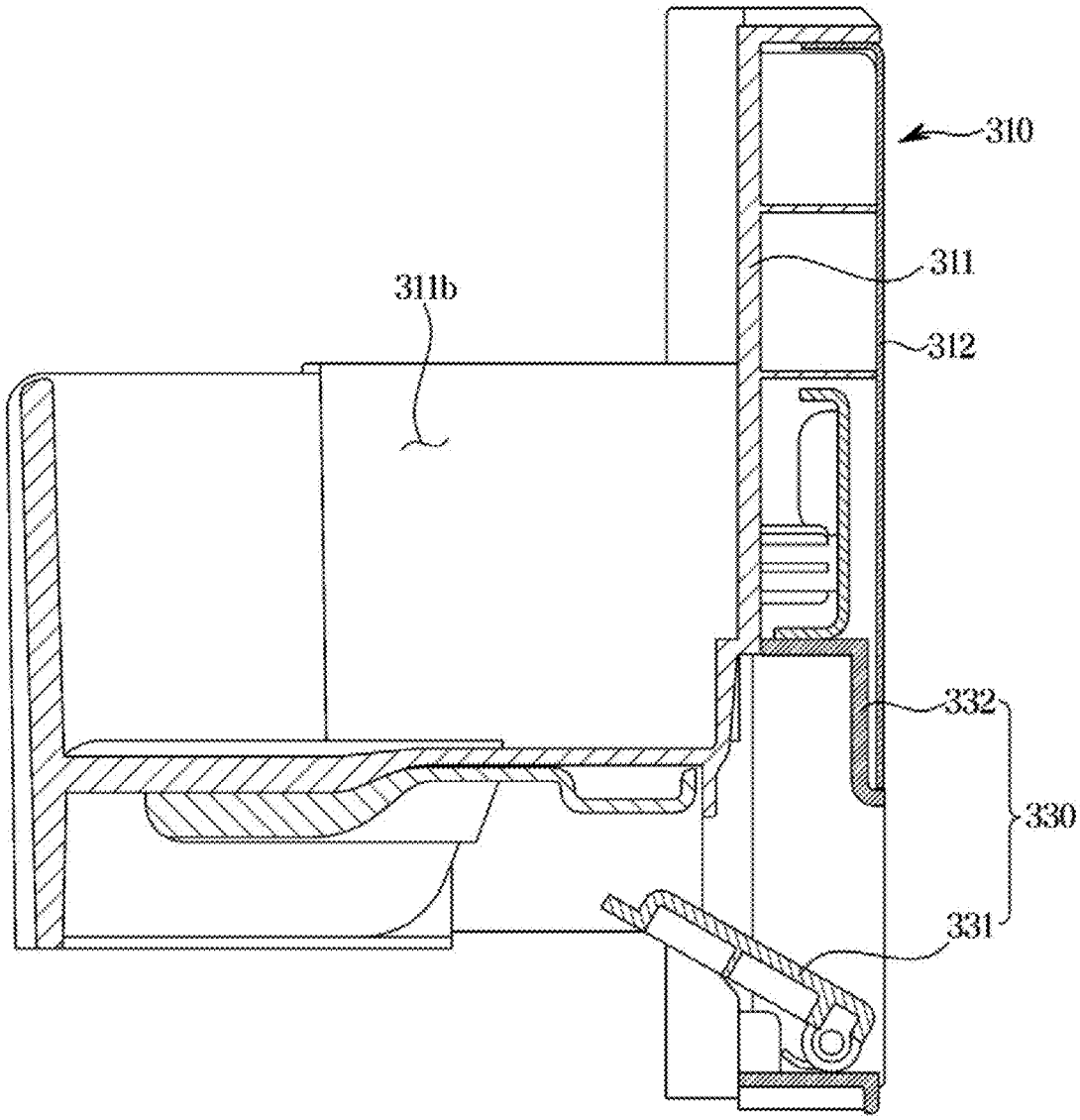
FIG. 19 illustrates a cross section taken along line C-C' indicated in FIG. 17.

FIG. 17 illustrates a state in which the lower door is opened in the clothes treating apparatus according to an embodiment of the present disclosure. FIG. 18 illustrates the detergent box and some exploded components of the lower door which are separated from the housing in the clothes treating apparatus according to an embodiment of the present disclosure. FIG. 19 illustrates a cross section taken along line C-C' indicated in FIG. 17.

Referring to FIG. 17, a clothes treating apparatus 2 according to an embodiment of the present disclosure, unlike the lower door 18 of the clothes treating apparatus 1 illustrated in FIG. 6, may include a lower door 310 slidably provided on the housing 10.

Referring to FIGS. 17 and 18, the clothes treating apparatus 2 according to an embodiment of the present disclosure may include a lower door 310 slidably provided on the housing 10, and a door rail device 320 supporting a sliding movement of the lower door 310.

The door rail device 320 may be mounted on the housing 10. As an example, the door rail device 320 may be fixed to the housing 10 in a state of being mounted on the base frame 111 of the detergent supply module 110. The door rail device 320 may be provided to support the sliding movement of the lower door 310.

The lower door 310 may be fixed to the door rail device 320. As an example, the lower door 310 may be fixed to the door rail device 320 by a fastening member. As the door rail device 320 operates, the lower door 310 may move with respect to the housing 10. The lower door 310 may be provided to accommodate a detergent box 301. The lower door 310 may be provided to cover the detergent box 301 when the detergent box 301 is mounted in the housing 10. The lower door 310 may be provided to be slidingly movable with respect to the housing 10.

The lower door 310 may include a door body 311. The door body 311 may be provided to accommodate the detergent box 301. The door body 311 may include a reinforcing mounting part 311*a* on which a door reinforcing part 313 is mounted. The door body 311 may include a detergent box accommodating part 311*b* accommodating the detergent box 301.

The lower door 310 may include a door cover 312. The door cover 312 may be provided to cover a front side of the door body 311. The door cover 312 may form an exterior of the lower door 310.

The lower door 310 may include the door reinforcing part 313. The door reinforcing part 313 may include a material with greater strength than the door body 311 and/or the door cover 312. The door reinforcing part 313 may be mounted on the reinforcing mounting part 311*a* of the door body 311.

The lower door 310 may include a rail bracket 314. The rail bracket 314 may be mounted on the door body 311. The rail bracket 314 may also be coupled to the door reinforcing part 313. The rail bracket 314 may be coupled to the door rail device 320. A plurality of the door rail devices 320 may be provided at both ends of the lower door 310, and the rail bracket 314 may extend between both the ends of the lower door 310. The rail bracket 314 may complement the sync of the plurality of door rail devices 320 coupled to both the ends of the lower door 310. When the lower door 310 is moved by the door rail devices 320 due to the rail bracket 314, both the left and right ends may be moved equally. The structural safety of the lower door 310 may be increased by the rail bracket 314.

The detergent box 301 may be detachably mounted on the door body 311 of the lower door 310. The detergent box 301 may be accommodated in the lower frame 101 of the housing 10 in a state of being seated on the lower door 310. The detergent box 301 may be separated from the lower door 310 in a state in which the lower door 310 slidingly moves with respect to the housing 10.

The lower door 310 may include a handle 330. The handle 330 may include a handle support 332 mounted on the door body 311 and a handle cover 331 rotatably mounted on the handle support 332.

Referring to FIGS. 17 and 19, as the user applies a force to the handle cover 331, the user may rotate the handle cover 331, and as the handle cover 331 is rotated, a portion that may be held by the user may be exposed. The user may move the lower door 310 by holding the handle 330.

As an example, the door rail device 320 may be configured to be capable of pulling the lower door 310 to the housing 10 when the lower door 310 approaches the housing 10 to a predetermined position. The door rail device 320 may be configured to be capable of automatically closing the lower door 310 when the user moves the lower door 310 to the predetermined position.

As an example, the door rail device 320 may be configured to be capable of pushing the lower door 310 away from the housing 10 when the lower door 310 moves away from the housing 10 to a predetermined position. The door rail device 320 may be configured to be capable of automatically opening the lower door 310 when the user moves the lower door 310 to the predetermined position.

According to this structure, the clothes treating apparatus 2 according to an embodiment of the present disclosure allows the user to easily withdraw or insert the detergent box 301.

The clothes treating apparatus 1 according to one embodiment includes the housing 10 having the laundry inlet 11, the tub 20 inside the housing and having an air inlet to receive air into the tub, and an air outlet to discharge air from the tub, the drying device 80 above the tub to remove moisture from air received through the air outlet, to heat the air, and to supply the heated air to the tub through the air inlet, and the detergent supply module 110. The detergent supply module includes the base frame 111, the drain pump 71 on the base frame and having a drain pump outlet, a circulation pump on the base frame and having a circulation pump inlet, the mixing case 620 on the base frame and having the mixing flow path 623 connecting the drain pump outlet and the circulation pump inlet, and the detergent pump 610 on the mixing case and configured to supply a detergent to the mixing flow path. The base frame is detachably mounted to the housing so that the detergent supply module is detachably mounted in the housing below the tub.

The clothes treating apparatus may further include the detergent box 601 configured to be docked with the detergent pump and to store the detergent. The housing may include the lower frame 101 in front of the detergent supply module to which the detergent box is detachably mounted.

The mixing case may include the detergent box space 620*s* to accommodate a portion of the detergent box. The mixing flow path may be partitioned from the detergent box space.

The detergent pump may include the detergent intake portion 611 extended in the detergent box space, and the detergent discharge portion 612 coupled to the mixing flow path.

The detergent box may include the docking portion 606 configured to be docked with the detergent intake portion, and the docking guide 609. The mixing case may include the guide coupling portion 629 configured to become coupled to the docking guide so that, when the detergent box is detachably mounted in the housing, docking of the docking portion with the detergent intake portion is guided as the docking guide and the guide coupling portion couple.

The clothes treating apparatus may further include the lower door 18 rotatably mounted on the housing to cover the detergent box when the detergent box is detachably mounted to the lower frame, and the door hinge 184 to support rotation of the lower door.

The clothes treating apparatus may further include the lower door 18 slidably movable with respect to the housing to cover the detergent box when the detergent box is mounted to the lower frame, and the door rail device 320 to support a sliding movement of the lower door.

The housing may include the lower bracket 106 between the detergent supply module and the lower frame, and having a material with greater strength than the lower frame.

The lower frame may include the detergent box guide 104 to guide detachable mounting of the detergent box to the lower frame.

The detergent supply module may include the drain connection pipe 121 connecting the drain pump outlet and the mixing flow path, and the circulation connection pipe 122 connecting the mixing flow path and the circulation pump.

The detergent supply module may include the drain connection part 221 connecting the drain pump outlet and the mixing flow path, the circulation connection part 222 connecting the mixing flow path and the circulation pump inlet, and the branch part 223 connecting the drain connection part and the circulation connection part and bypassing the mixing flow path.

The mixing case may include the mixing inlet 624 connected to the drain pump outlet, and the mixing outlet 625 connected to the circulation pump inlet. The mixing flow path may be between the mixing inlet and the mixing outlet.

The bottom surface 626 of the mixing flow path may be at a position equal to or lower than bottom surfaces of the mixing inlet and the mixing outlet.

The circulation pump may have a circulation pump outlet. The clothes treating apparatus may further include the circulation guide 77 connecting the circulation pump outlet and the tub. The circulation pump may be configured to supply water and the detergent in the mixing flow path to the tub through the circulation guide.

The drain pump may be configured to discharge water from the tub into the mixing flow path or to an outside of the housing.

The clothes treating apparatus 1 according to one embodiment includes the housing 10 in which the laundry inlet 11 is formed, the tub 20 provided inside the housing to store washing water, the detergent supply module 110 disposed below the tub to be mounted in the housing, and the detergent box 601 detachably mounted in the housing to be capable of being docked with the detergent supply module. The detergent supply module includes the base frame 111 mounted to the housing, the drain pump 71 and the circulation pump 76 mounted on the base frame, the mixing case 620 mounted on the base frame between the drain pump and the circulation pump to be capable of accommodating at least a portion of the detergent box and form the mixing flow path 623, and the detergent pump 610 mounted on the mixing case to be capable of being docked with the detergent box and configured to intake the detergent from the detergent box and supply the intaken detergent to the mixing flow path when docked with the detergent box.

The clothes treating apparatus may further include the circulation guide 77 connecting the circulation pump and the tub. The circulation pump may be configured to supply the water and detergent in the mixing flow path of the mixing case to the tub through the circulation guide.

The mixing case may include the detergent box space 620*s* provided to accommodate a portion of the detergent box. The mixing flow path may be provided to be partitioned from the detergent box space. The detergent pump may include the detergent intake portion 611 located in the detergent box space when the detergent pump is mounted on the mixing case, and the detergent discharge portion 612 located in the mixing flow path when the detergent pump is mounted on the mixing case.

The clothes treating apparatus may further include the lower door 18 rotatably mounted on the housing to cover the detergent box when the detergent box is mounted in the housing, and the door hinge 184 provided to support rotation of the lower door.

The detergent supply module may include the drain connection pipe 121 connecting the drain pump and the mixing case, and the circulation connection pipe 122 connecting the mixing case and the circulation pump.

According to a clothes treating apparatus of the present disclosure, components for supplying a detergent to the tub are provided as a single module, so that maintenance and/or repair of the components may be easy.

Effects obtainable from the present disclosure are not limited to the effects mentioned above, and other effects not mentioned will be clearly understood by those skilled in the art from the description below.

The foregoing has illustrated and described specific embodiments. However, it should be understood by those of skilled in the art that the present disclosure is not limited to the above-described embodiments, and various changes and modifications may be made without departing from the technical idea of the present disclosure described in the following claims.

The invention claimed is:

1. A clothes treating apparatus comprising:

a housing having a laundry inlet;

a tub inside the housing and having an air inlet to receive air into the tub, and an air outlet to discharge air from the tub;

a drying device above the tub to remove moisture from air received through the air outlet, to heat the air, and to supply the heated air to the tub through the air inlet; and a detergent supply module including:

a base frame, a drain pump on the base frame and having a drain pump outlet, a circulation pump on the base frame and having a circulation pump inlet, a mixing case on the base frame, the mixing case including an intake opening and a mixing flow path connecting the drain pump outlet and the circulation pump inlet, and a detergent pump on the mixing case and configured to supply a detergent to the mixing flow path, the detergent pump including a detergent intake portion that passes through the intake opening, wherein the base frame is detachably mounted to the housing se such that the detergent supply module is detachably mounted in the housing below the tub.

2. The clothes treating apparatus according to claim 1, further comprising:

a detergent box configured to be docked with the detergent pump and to store the detergent, wherein the housing includes a lower frame in front of the detergent supply module to which the detergent box is detachably mounted.

3. The clothes treating apparatus according to claim 2, wherein the mixing case includes a detergent box space to accommodate a portion of the detergent box, and the mixing flow path is partitioned from the detergent box space.

4. The clothes treating apparatus according to claim 3, wherein:

the detergent intake portion is extended in the detergent box space, and the detergent pump further includes a detergent discharge portion coupled to the mixing flow path.

5. The clothes treating apparatus according to claim 4, wherein the detergent box includes:

a docking portion configured to be docked with the detergent intake portion, and a docking guide, and the mixing case includes a guide coupling portion configured to become coupled to the docking guide se-such that, when the detergent box is detachably mounted in the housing, docking of the docking portion with the detergent intake portion is guided as the docking guide and the guide coupling portion couple.

6. The clothes treating apparatus according to claim 2, further comprising:

a lower door rotatably mounted on the housing to cover the detergent box when the detergent box is detachably mounted to the lower frame; and a door hinge to support rotation of the lower door.

7. The clothes treating apparatus according to claim 2, further comprising:

a lower door slidably movable with respect to the housing to cover the detergent box when the detergent box is mounted to the lower frame; and a door rail device to support a sliding movement of the lower door.

8. The clothes treating apparatus according to claim 2, wherein the housing includes a lower bracket between the detergent supply module and the lower frame, and having a material with greater strength than the lower frame.

9. The clothes treating apparatus according to claim 2, wherein the lower frame includes a detergent box guide to guide detachable mounting of the detergent box to the lower frame.

10. The clothes treating apparatus according to claim 1, wherein the detergent supply module includes:

a drain connection pipe connecting the drain pump outlet and the mixing flow path, and a circulation connection pipe connecting the mixing flow path and the circulation pump.

11. The clothes treating apparatus according to claim 1, wherein the detergent supply module includes:

a drain connection part connecting the drain pump outlet and the mixing flow path, a circulation connection part connecting the mixing flow path and the circulation pump inlet, and a branch part connecting the drain connection part and the circulation connection part and bypassing the mixing flow path.

12. The clothes treating apparatus according to claim 1, wherein the mixing case includes:

a mixing inlet connected to the drain pump outlet, and a mixing outlet connected to the circulation pump inlet, and the mixing flow path is between the mixing inlet and the mixing outlet.

13. The clothes treating apparatus according to claim 12, wherein a bottom surface of the mixing flow path is at a position equal to or lower than bottom surfaces of the mixing inlet and the mixing outlet.

14. The clothes treating apparatus according to claim 1, wherein the circulation pump has a circulation pump outlet, and the clothes treating apparatus further includes:

a circulation guide connecting the circulation pump outlet and the tub, and the circulation pump is configured to supply water and the detergent in the mixing flow path to the tub through the circulation guide.

15. The clothes treating apparatus according to claim 1, wherein the drain pump is configured to discharge water from the tub into the mixing flow path or to an outside of the housing.

16. The clothes treating apparatus according to claim 1, wherein the mixing case further includes a tray below the detergent intake portion, the tray configured to catch detergent and/or water discharged from the detergent intake portion, and the tray is detachable from the mixing case.

17. A clothes treating apparatus comprising:

a housing having a laundry inlet;

a tub inside the housing and having an air inlet to receive air into the tub, and an air outlet to discharge air from the tub;

a drying device above the tub to remove moisture from air received through the air outlet, to heat the air, and to supply the heated air to the tub through the air inlet;

a detergent box configured to store a detergent and including a docking guide; and a detergent supply module including:

a base frame, a drain pump on the base frame and having a drain pump outlet, a circulation pump on the base frame and having a circulation pump inlet, a mixing case on the base frame, the mixing case including a guide coupling portion and a detergent box space configured to accommodate a portion of the detergent box and a mixing flow path connecting the drain pump outlet and the circulation pump inlet, and a detergent pump on the mixing case and to which the detergent box is dockable, the detergent pump including a detergent intake portion and configured to supply a detergent to the mixing flow path, wherein the detergent box, the mixing case, and the detergent pump are configured such that, when the detergent box is detachably mounted in the housing, docking of the docking portion with the detergent intake portion is guided as the docking guide and the guide coupling portion couple, and with the docking guide and the guide coupling portion coupled, the detergent box is docked to the detergent pump, and the base frame is detachably mounted to the housing such that the detergent supply module is detachably mounted in the housing below the tub.

18. A clothes treating apparatus comprising:

a housing having a laundry inlet;

a tub inside the housing and having an air inlet to receive air into the tub, and an air outlet to discharge air from the tub;

a drying device above the tub to remove moisture from air received through the air outlet, to heat the air, and to supply the heated air to the tub through the air inlet; and a detergent supply module including:

a base frame, a drain pump on the base frame and having a drain pump outlet, a circulation pump on the base frame and having a circulation pump inlet, a mixing case on the base frame and having a mixing flow path connecting the drain pump outlet and the circulation pump inlet, a detergent pump on the mixing case and configured to supply a detergent to the mixing flow path, and a branch part connecting the drain pump outlet and the circulation pump inlet and bypassing the mixing flow path, wherein the base frame is detachably mounted to the housing so that the detergent supply module is detachably mounted in the housing below the tub.

* * * * *